US006023935A

United States Patent [19]

Okazaki et al.

[11] Patent Number: 6,023,935

[45] Date of Patent: Feb. 15, 2000

[54] AIR CONDITIONER

[75] Inventors: Takashi Okazaki; Yoshihiro Sumida; Akihiro Matsushita; Itsutarou Akiyama; Yasunori Shida; Akio Fukushima, all of Tokyo, Japan

[73] Assignee: Mitsubishi Denki Kabushiki Kaisha, Tokyo, Japan

[21] Appl. No.: 09/188,234

[22] Filed: Nov. 9, 1998

[30] Foreign Application Priority Data

Feb. 23, 1998 [JP] Japan ..... 10-040402

[51] Int. Cl.[7] ..... F25D 15/00

[52] U.S. Cl. ..... 62/119; 62/196.3; 62/472; 62/503; 62/DIG. 22

[58] Field of Search ..... 62/119, DIG. 22, 62/503, 470, 512, 472, 196.3; 165/150

[56] References Cited

U.S. PATENT DOCUMENTS 4,904,165 2/1990 Fraser, Jr. et al. ..... 417/312

FOREIGN PATENT DOCUMENTS 53-126555 11/1978 Japan .

9-250779 9/1997 Japan .

*Primary Examiner*—Henry Bennett
*Assistant Examiner*—Marc Norman
*Attorney, Agent, or Firm*—Burns, Doane, Swecker & Mathis, LLP

[57] ABSTRACT

An air conditioner has a refrigeration circuit formed by sequentially connecting a compressor 1, a condenser 2, an electronic expansion valve 4 and an evaporator 7 by pipes (6, 10). A compressor bypass pipe 12 is provided to connect an outlet of the evaporator 7 with an inlet of the condenser 2. A first on-off valve 11 is located in the bypass pipe 12. The air conditioner is controlled to switch to either a forced circulation operation or a natural circulation operation. In the forced circulation operation, the first on-off valve 11 is closed, the expansion valve 4 is opened to a first degree to allow refrigerant to pass therethrough, and the compressor 1 is operated in a running state. In the natural circulation operation, the first on-off valve 11 is opened, the expansion valve 4 is opened to a second degree, different from the first degree, to allow refrigerant to pass therethrough, and the compressor 1 is stopped.

22 Claims, 15 Drawing Sheets

AIR CONDITIONER

BACKGROUND OF THE INVENTION

1. Field of the Invention

The present invention relates to an air conditioner capable of running through a year regardless of an outside air temperature, and particularly, to an air conditioner capable of running in forced circulation operation with a compressor run and natural circulation operation with the compressor stopped.

2. Discussion of Background

In recent years, a technical field of removing heat of electronic machines represented by, for example a computer center and a base station (i.e., shelter) accommodating relay electronic machines for mobile communication is rapidly developing in accordance with the spread of mobile communication, such as using a portable telephone. Such locations accommodating the electronic machines have to be subjected to air cooling throughout a year.

In such usage, when an outdoor air temperature is low as in a winter season or a night time, it is possible to cool by air ventilation. However, a device for preventing fog, rain, snow, dust and so on from penetrating thereinto becomes necessary and stable air-cooling cannot be performed because an indoor air temperature varies depending on a variation of the outdoor air temperature. Under such conditions, it is possible to use an air conditioner utilizing natural circulation by which heat can be transferred by a refrigerant from indoors to outdoors by using a difference of temperature between the indoor temperature and the outdoor air temperature. The air conditioner utilizing this natural circulation drastically reduces an annual power consumption in comparison with an air conditioner using the forced circulation by a compressor.

Now, an operational principle of air-cooling by the natural circulation will be described with reference to FIG. 15. FIG. 15 shows a structure of an air conditioner utilizing the natural circulation. In FIG. 15, numerical reference 2 designates a condenser; numerical reference 3 designates an outdoor fan; numerical reference 5 designates an outdoor unit; numerical reference 6 designates a liquid pipe; numerical reference 7 designates an evaporator; numerical reference 8 designates an indoor fan; numerical reference 9 designates an indoor unit provided in a space to be air-conditioned; and numerical reference 10 designates a gas pipe.

When the condenser 2 is arranged at a relatively higher position than the evaporator 7, a liquid refrigerant condensed by the condenser 2 flows into the evaporator 7 after descending through the liquid pipe 6 by gravity. The liquid refrigerant delivered into the evaporator 7 evaporates by receiving a thermal load of the indoor region, for example, a space to be air-conditioned. Thereafter, the liquid refrigerant ascends through the gas pipe 10 to thereby return to the condenser 2, whereby a cycle is formed.

Thus, the air-cooling by the natural circulation utilizes a density variation between a liquid refrigerant and a gas refrigerant derived from an altitudinal difference between the indoor unit 9 and the outdoor unit 5, as driving force for circulating the refrigerant. The natural circulation can be realized in a case that the sum of a pressure loss in a refrigerant path such as the condenser 2, the evaporator 7, the liquid pipe 6, the gas pipe 10, and on-off valves in a refrigerant circuit is equal to a pressure increase in the liquid pipe 6 caused by a height of liquid column.

In FIG. 16, a pressure-enthalpy diagram in a cycle of air-cooling by forced circulation operation utilizing a generally used compressor is shown. In FIG. 16, an abscissa designates an enthalpy and an ordinate designates a pressure. In comparison therewith, a pressure-enthalpy diagram in a cycle of natural circulation operation without using a compressor is shown in FIG. 17. Also in FIG. 17, an abscissa designates an enthalpy and an ordinate designates a pressure. A cycle of air-cooling operation by the forced circulation is performed by a structure that a compressor, a condenser, an expansion valve, and an evaporator are sequentially connected by pipes.

In FIG. 16, numerical reference 34 designates an enthalpy decrease and a pressure drop in the condenser; numerical reference 35 designates a pressure drop by the expansion valve; numerical reference 36 designates an enthalpy increase and a pressure drop in the evaporator; numerical reference 37 designates an enthalpy increase and a pressure rise by the compressor; numerical reference 38 designates a refrigerant pressure corresponding to an indoor temperature; and numerical reference 39 designates a refrigerant pressure corresponding to an outdoor air temperature. An arrow shown in FIG. 16 designates a flow direction of the refrigerant. Further, in FIG. 17, numerical reference 40 designates an enthalpy increase and a pressure drop in the evaporator; numerical reference 41 designates a pressure drop in the gas pipe; numerical reference 42 designates an enthalpy decrease and a pressure drop in the condenser; and numerical reference 43 designates a pressure increase obtained by subtracting the pressure drop in the liquid pipe from the pressure rise by the altitudinal difference in the liquid pipe. In comparing FIG. 16 to FIG. 17, a characteristic that an enthalpy variation in the evaporator and an enthalpy variation in the condenser are substantially equal in the cycle of air-cooling by the natural circulation, not like the cycle of air-cooling by the forced circulation utilizing the compressor, and the flow direction of refrigerant are adverse.

Meanwhile, as an Example of air conditioner utilizing the natural circulation, both of an air-cooling operation by the forced circulation utilizing a compressor (hereinbelow, referred to as forced circulation operation) and an air-cooling operation by the natural circulation (hereinbelow, referred to as natural circulation operation) are used as disclosed in Japanese Unexamined Patent Publication Hei. 9-250779 (JP-A-9-250779). FIG. 18 shows a structure of a conventional air conditioner which can perform both of the forced circulation operation and the natural circulation operation.

In FIG. 18, numerical reference 1 designates a compressor; numerical reference 2 designates a condenser; numerical reference 3 designates an outdoor fan; and numerical reference 6 designates a liquid pipe; numerical reference 7 designates an evaporator; numerical reference 9 designates an indoor unit; numerical reference 10 designates a gas pipe; numerical reference 12 designates a bypass pipe for compressor which is provided for bypassing the compressor 1; numerical reference 14 designates an accumulator; numerical reference 13, 22, 44, and 45 respectively designate an on-off valve; numerical reference 46 designates an expansion valve; and numerical reference 23 designates a bypass pipe for bypassing the expansion valve 46 and the on-off valve 45.

In this air conditioner, there are provide the four on-off valves 13, 44, 22, and 45 for bypassing the compressor 1 and the expansion valve 46. The condenser 2 is arranged at a relatively higher position than the evaporator 7, wherein a cycle of natural circulation operation is realized by opening the on-off valves 44 and 22 and closing the on-off valves 13 and 45 when an indoor temperature is lower than an outdoor air temperature. In other words, a liquid refrigerant condensed by the condenser 2 descends through the liquid pipe 6 by the gravity and flows into the evaporator 7 through the on-off valve 22 in the bypass pipe of the expansion valve. The liquid refrigerant delivered into the evaporator 7 evaporates by receiving a thermal load in the indoor. Thereafter, the refrigerant ascends through the gas pipe 10 and the passing through the on-off valve 44 of the bypass pipe for compressor 12, and returns to the condenser 2, whereby a cycle is formed.

When the indoor temperature is higher than the outdoor air temperature, the on-off valves 13 and 45 are opened and the on-off valves 44 and 22 are closed to run in a cycle of forced circulation by running the compressor 1. In other words, the refrigerant gas in the pipe is adiabatically compressed by the compressor 1 to be in a super heated state, whereby the refrigerant radiates its heat to the outdoor air by the condenser 2 and is liquefied to be thereby changed to a refrigerant liquid. Thereafter, the high pressure refrigerant liquid descends through the liquid pipe 6, passes through the on-off valve 45, and depressurized by the expansion valve 46. Thus the refrigerant liquid is changed to wet-vapor of low-temperature and low-pressure under a condition of gas-liquid mixture. Further, the refrigerant absorbers a heat of evaporation from the evaporator 7 to thereby change to a refrigerant gas. Thereafter, the refrigerant gas returns to the compressor 1 after passing through the gas pipe 10 and the accumulator 14. At this time, an excessive refrigerant for the forced circulation operation is stored in the accumulator.

Thus, in this air conditioner, it is possible to drastically reduce an annual power consumption because the forced circulation operation and the natural circulation operation are switched depending on an outdoor temperature and an indoor temperature and when the natural circulation operation is conducted the driving force becomes only an input to the indoor fan 3. Further, not shown herein, there are many cases that an indoor fan is provided on the side of the indoor unit 9. In such cases of using a unit having both of an outdoor fan and an indoor fan, the annual power consumption can be drastically reduced.

In this, a quantity of refrigerant required for the natural circulation operation is generally greater than that for the forced circulation operation because of a difference in a condition of the refrigerant in the refrigerant circuit. Therefore, the conventional air conditioner had a structure such that the expansion valve 46, which has been used to be provided at around the outlet of the condenser 2, was disposed at the side of indoor unit so that a difference between the quantity of refrigerant under the natural circulation operation and that under the forced circulation operation could be absorbed. Practically, when the forced circulation operation is switched to the natural circulation operation, an excessive refrigerant stored in the accumulator 14 at the time of forced circulation operation should have been collected to send it back to the condenser 2 before the natural circulation operation is performed by a refrigerant recovery operation. Accordingly, in a conventional air conditioner in which forced circulation operation and natural circulation operation were combined had four on-off valves 44, 13, 22, and 45 and pipes for connecting these in order to switch the refrigerant circuit between these operations and recover the refrigerant at the time of switching the operations.

Further, the temperature in a base station accommodating a computer center and a relay electronic machine for mobile communication is controlled in a range of about 25° C. through 35° C. However, when an outdoor air temperature is low as in a winter season or the like, cooling capability obtainable by natural circulation operation is increased, whereby the compressor 1 is in a stopped state for a long time and the temperature of the compressor decreases in accordance with a lapse of time. As the temperature of the compressor 1 decreases, the refrigerant gas is gradually condensed in the compressor 1 by a cycle of the natural circulation operation. Therefore, there was a possibility that not only the quantity of refrigerant necessary for the natural circulation operation was not secured but also a phenomenon of reaching a breakage by a generation of a compression of liquid refrigerant was caused at a time of starting the compressor 1.

In the conventional air conditioner using a combination of forced circulation operation and natural circulation operation, four on-off valves 44, 13, 22, and 45 for switching refrigerant circuits with respect to these types of operation and pipes of connecting these valves for recovering the refrigerant at the time of switching the operations were provided. There was a problem that a system using the combination of the forced circulation operation and the natural circulation operation became costly in comparison with an air conditioner using only a forced circulation because expensive on-off valves having a large inner diameter were used to reduce a pressure loss for the on-off valves 22, 44 provided in refrigerant paths for the natural circulation operation among the above on-off valves. Further, there was a problem that accommodation into an outdoor unit 5 was difficult because the refrigerant circuit was complicated by existence of many on-off valves and the space in the outdoor unit 5 is limited.

Further, at the time of switching to the natural circulation operation, it was necessary to perform refrigerant recovery operation for recovering an excessive refrigerant accumulated in the accumulator 14 at the time of the forced circulation operation on the side of condenser 2. However, when the refrigerant recovery operation was performed by completely closing the expansion valve 46, a suction pressure by the compressor 1 was abruptly reduced, whereby a refrigerant liquid taken in by the compressor 1 was gassed and a refrigerating machine oil flowed out to the refrigerant circuit along with the discharging gas, whereby there was a possibility that seizure was caused by mal-lubrication by the reduced quantity of refrigerating machine oil in the compressor.

Further, the refrigerating machine oil flowed into the refrigerant circuit causing an increment of pressure loss, whereby cooling capability in the natural circulation operation was deteriorated.

Further, when an outdoor temperature was low, such as in a winter season, the cooling capability obtainable by the natural circulation operation was increased, whereby the compressor was stopped for a long time and the temperature of compressor 1 was decreased in accordance with a lapse of time. In such a case, the refrigerant gas was gradually condensed from the natural circulation circuit to the compressor 1, whereby not only the quantity of refrigerant necessary for the natural circulation operation could not be secured but also there was a possibility that breakage occurred by a compression of the liquid refrigerant at the time of starting the compressor 1.

Further, when a flowing direction of the refrigerant in the condenser 2 is upward and when a stand-up pipe vertically existed in connection piping between the outlet of the condenser 2 and the liquid pipe 6, there was a problem that stable cooling capability was not obtainable because the condensed refrigerant liquid was accumulated in a middle of a heat transmission pipe in the condenser 2 or in a middle of a connection pipe and therefore the natural circulation operation became unstable.

SUMMARY OF THE INVENTION

The present invention is to solve the above-mentioned problems inherent in the prior art. It is an object of the present invention to obtain an air conditioner which can perform both of forced circulation operation and natural circulation operation and has a refrigerant circuit of a simple structure by reducing the number of on-off valves necessary for switching to routes for these cycles.

Further, it is an object of the present invention to obtain an air conditioner which can smoothly switch the operations without abruptly lowering a suction pressure of the compressor 1 when a refrigerant is recovered.

Further, it is an object of the present invention to obtain an air conditioner which can perform both of forced circulation operation and natural circulation operation and stably serve appropriate cooling capability by preventing a flow of a refrigerant gas into the compressor 1 even in a stopped state of the compressor 1 for a long time.

Further, it is an object of the present invention to obtain an air conditioner which can prevent a condensed refrigerant liquid accumulating in a middle of a heat transfer pipe of the condenser 2 and in a middle of a connection pipe.

According to a first aspect of the present invention, there is provided an air conditioner comprising a refrigeration circuit formed by sequentially connecting a compressor, a condenser, an electronic expansion valve capable of controlling an opening degree thereof, and an evaporator by pipes and a compressor bypass pipe for connecting an outlet of the evaporator and an inlet of the condenser interposing a first on-off valve, wherein the air conditioner is switched to forced circulation operation in which the first on-off valve is closed and the compressor is in a running state or to natural circulation operation in which the first on-off valve is opened and the compressor is in a stopping state and the opening degree of the electronic expansion valve is controlled respectively in accordance with the forced circulation operation and the natural circulation operation.

According to a second aspect of the present invention, there is provided an air conditioner according to the first aspect of the invention, wherein the first on-off valve is a check valve for allowing a flow of refrigerant from the outlet of the evaporator to the inlet of the condenser and prohibiting a back flow flowing.

According to a third aspect of the present invention, there is provided an air conditioner according to the first aspect or the second aspect of the invention, further comprising an accumulator provided in a pipe between an inlet of the compressor bypass pipe and an inlet of the compressor.

According to a fourth aspect of the present invention, there is provided an air conditioner according to the third aspect of the invention, further comprising a second on-off valve between the inlet of the compressor bypass pipe and an inlet of the accumulator.

According to a fifth aspect of the present invention, there is provided an air conditioner according to the third aspect of the invention, further comprising a heating means for heating a refrigerant in the accumulator.

According to a sixth aspect of the present invention, there is provided an air conditioner according to any one of the proceeding aspects, further comprising a third on-off valve provided in a pipe between an outlet of the compressor and an outlet of the compressor bypass pipe.

According to a seventh aspect of the present invention, there is provided an air conditioner according to the sixth aspect of the invention, wherein the third on-off valve is a check valve which allows a flow of refrigerant from the outlet of the compressor to the outlet of the compressor bypass pipe and prohibits a back flow flowing.

According to an eighth aspect of the present invention, there is provided an air conditioner according to any one of the third aspect through the seventh aspect of the invention, further comprising a bypass pipe for connecting a high-pressure pipe between an outlet of the compressor and the inlet of the condenser to a low pressure pipe between an outlet of the electronic expansion valve and the inlet of the compressor, and a fourth on-off valve interposed into this bypass pipe.

According to a ninth aspect of the present invention, there is provided an air conditioner according to any one of the preceding aspects of the invention, further comprising a liquid receiver for storing a refrigerant liquid provided in a pipe between an outlet of the condenser and an inlet of the electronic expansion valve.

According to a tenth aspect of the present invention, there is provided an air conditioner according to any one of the proceeding aspects of the invention, further comprising an oil separator for separating a refrigerating machine oil provided in the pipe between an outlet of the compressor and the inlet of the condenser.

According to an eleventh aspect of the present invention, there is provided an air conditioner according to any one of the proceeding aspects of the invention, further comprising an expansion valve bypass pipe for connecting an outlet of the condenser and an inlet of the evaporator, and a fifth on-off valve interposed in the expansion valve bypass pipe.

According to a twelfth aspect of the present invention, there is provided an air conditioner comprising a refrigeration circuit formed by sequentially connecting a compressor, a condenser, an expansion valve, and an evaporator by pipes, a compressor bypass pipe for connecting an outlet of the evaporator and an inlet of the condenser interposing a first on-off valve, and a third on-off valve provided in a pipe between an outlet of the compressor and an outlet of the compressor bypass pipe, wherein forced circulation operation in which the first on-off valve is closed and the third on-off valve is opened to render the compressor in a running state and natural circulation operation in which the first on-off valve is opened and the third on-off valve is closed to render the compressor in a stopping state is selectively switchable.

According to a thirteenth aspect of the present invention, there is provided an air conditioner according to a twelfth aspect of the invention, wherein the third on-off valve is a check valve which allows a flow of refrigerant from the outlet of the compressor to the outlet of the compressor bypass pipe and prohibits the back flow flowing.

According to a fourteenth aspect of the present invention, there is provided an air conditioner according to any one of the proceeding aspects of the invention, wherein a refrigerant flowed into the condenser flows downward in the condenser.

According to the fifteenth aspect of the present invention, there is provided an air conditioner according to the fourteenth aspect of the invention, wherein a plurality of refrigerant paths are provided in the condenser by dividing refrigerant pipes up and down; branches of the refrigerant respectively pass through the refrigerant paths downward and join at an outlet of the condenser; and a subcooling portion is provided in a lower portion of the condenser.

According to a sixteenth aspect of the present invention, there is provided an air conditioner according to the fourteenth aspect or the fifteenth aspect of the invention, wherein a plurality of refrigerant paths are provided in the condenser by dividing refrigerant pipes up and down; branches of the refrigerant respectively flow through the refrigerant paths downwardly and join at an outlet of the condenser; and the length of the upper refrigerant path is longer than the length of the lower refrigerant path.

According to a seventeenth aspect of the present invention, there is provided an air conditioner according to any one of the proceeding aspects of the invention, wherein the refrigerant flowed into the evaporator flows upward in the evaporator.

According to an eighteenth aspect of the present invention, there is provided an air conditioner according to any one of the proceeding aspects of the invention, wherein the tube diameter of the pipe between the outlet of the evaporator and the inlet of the condenser is larger than the tube diameter of the pipe between an outlet of the condenser and an inlet of the evaporator.

According to a nineteenth aspect of the present invention, there is provided an air conditioner according to any one of the proceeding aspects of the invention, wherein an area of heat transfer surface of the evaporator is larger than that of the condenser.

According to a twentieth aspect of the present invention, there is provided an air conditioner according to any one of the proceeding aspects of the invention, wherein the height of an outlet of refrigerant pipe of the condenser is higher than the height of an outlet of refrigerant pipe of the evaporator by 0.5 m or more and 2 m or less.

According to a twenty-first aspect of the present invention, there is provided an air conditioner according to any one of the proceeding aspects of the invention, wherein a connecting portion between an outlet of the refrigerant pipe of the condenser and a liquid pipe composing of the refrigeration circuit is disposed at a lower portion than a bottom portion of a receiver of the condenser.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

A detailed explanation will be given of preferred embodiments of the present invention in reference to FIGS. 1 through 17 as follows, wherein the same numerical references are used for the same or the similar portions and description of these portions is omitted.

Figure 1:
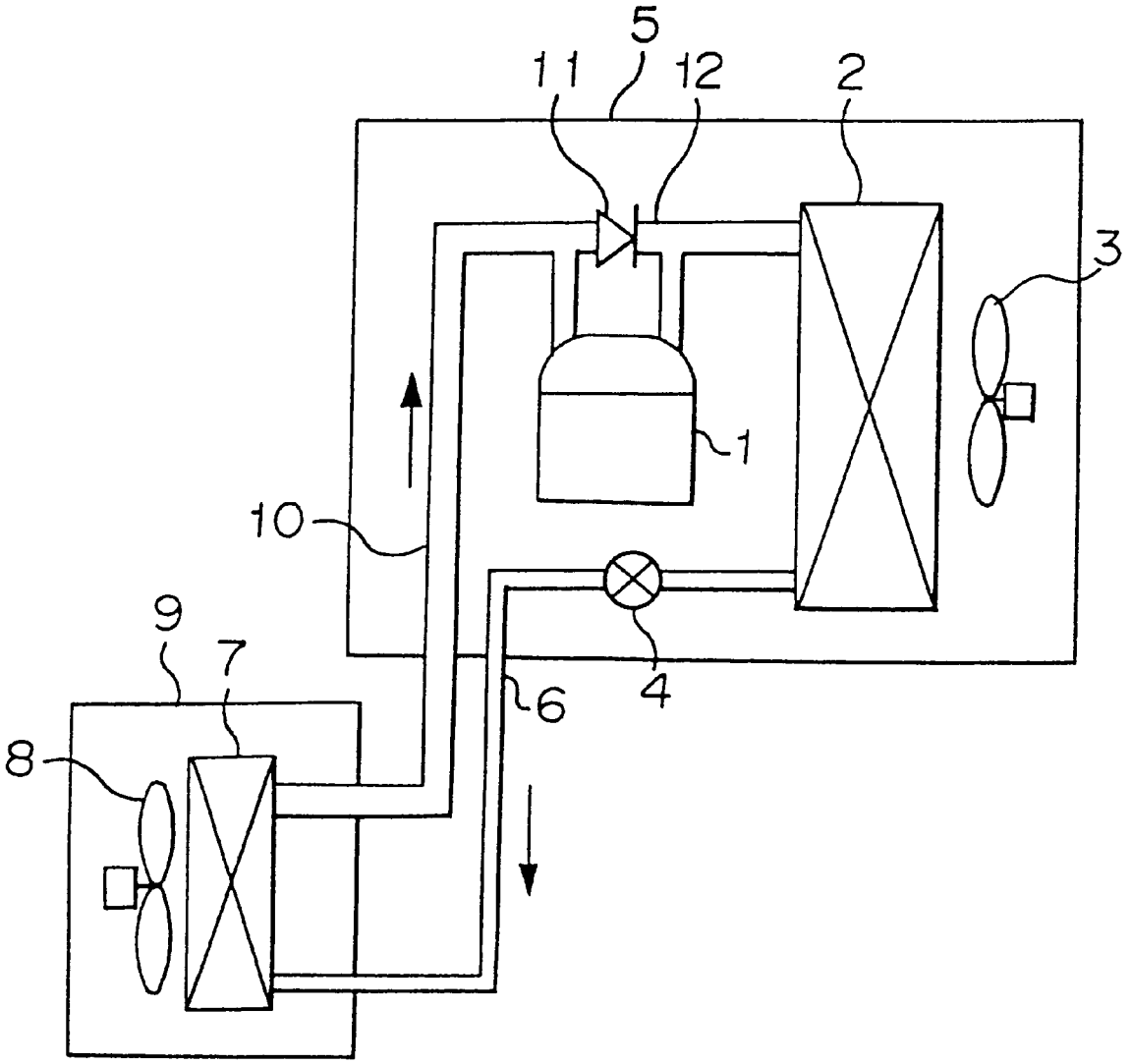
FIG. 1 schematically shows a structure of an air conditioner according to Embodiment 1 of the present invention.

Hereinbelow, as an air conditioner in accordance with Embodiment 1, a cooling unit is exemplified. FIG. 1 schematically shows a structure of an air conditioner according to this Embodiment. In the Figure, numerical reference 1 designates a compressor; numerical reference 2 designees a condenser; numerical reference 3 designates an outdoor fan; numerical reference 4 designates an expansion valve, for example, an electronic expansion valve; numerical reference 5 designates an outdoor unit; numerical reference 6 designates a liquid pipe; numerical reference 7 designates an evaporator; numerical reference 8 designates an indoor fan; numerical reference 9 designates an indoor unit; numerical reference 10 designates a gas pipe; numerical reference 11 designates an on-off valve (a first on-off valve), for example, a check valve; and numerical reference 12 designates a compressor bypass pipe. In FIG. 1, an arrow designates a flowing direction of refrigerant.

The electronic expansion valve is an expansion valve which can be externally controlled so that an opening degree thereof can be set by an electric current to be applied thereto. In this Embodiment, forced circulation operation and natural circulation operation are switched over by setting different opening degrees. The gas pipe 10 is provided between an outlet of the evaporator 7 and an inlet of the condenser 2, and a liquid pipe 6 is provided between an outlet of the condenser 2 and an inlet of the evaporator 7. In this, the diameter of gas pipe 10 is 1.5 through 2 times larger than that of liquid pipe 6 so that the gas pipe is wider than the liquid pipe 6.

Further, in this Embodiment, a fluorocarbon refrigerant such as R22 or R-407C is used as a refrigerant; as the compressor, for example, a scroll compressor is used; and as a refrigerating machine oil, for example, alkylbenzene oil, ester oil, or the like is use. However, it is not limited to used these specific items and other refrigerants, other compressors and/or other refrigerating machine oils can be used.

As shown in FIG. 1, the air conditioner comprises the outdoor unit 5, the indoor unit 9, and the liquid pipe 6 and the gas pipe 10 both for connecting these units.

The outdoor unit 5 comprises the compressor 1 for compressing a refrigerant gas, the condenser 2 for cooling and liquefying the refrigerant gas, the outdoor fan 3 for forcibly supplying outdoor air to an outer surface of the condenser 2, the electronic expansion valve 4 for depressurizing a high-temperature high-pressure refrigerant liquid come out of the condenser 2 to render it wet-vapor in a two-phase state, and the compressor bypass pipe 12 provided with the check valve 11 for bypassing the compressor 1 under the natural circulation operation.

Further, indoor unit 9 comprises the evaporator 7 for vaporizing the wet-vapor flowed from the liquid pipe 6 by an air conditioning load in a room, which is a space to be air-conditioned by rendering the refrigerant a gas, and the indoor fan 8 for forcibly supplying an indoor air to an outer surface of the evaporator 7.

The condenser 2 of the outdoor unit 5 is arranged at a higher position than that of the evaporator 7 of the indoor unit 9, wherein, for example, an altitudinal difference of about 1.2 m is given.

Such an air conditioner is utilized in, for example, a location requiring air-cooling through a year. When the indoor temperature is lower than the outdoor air temperature, the forced circulation operation, in which the compressor 1 is in a running state, is performed, and when the indoor temperature is higher than the outdoor temperature, the natural circulation operation utilizing cold heat of an outer air and stopping the compressor 1 is performed. Now, the forced circulation operation will be described.

When the opening degree of the electronic expansion valve 4 is appropriate for depressurizing a refrigerant liquid flowed out of the condenser 2 to render it wet-vapor in two-phase state, for example, in a case that an electronic expansion valve 4, of which full opening degree is 2000 pulse, is used, by setting the opening degree to about 15%, for example, 300 pulse, the check valve 11 is closed by a difference of pressure between a discharge pressure and a suction pressure of the compressor 1 to form a circuit for the forced circulation operation upon running of the compressor 1. Namely, a refrigerant gas in this pipe is adiabatically compressed by the compressor 1 to be a state of super heat and succeedingly the refrigerant gas emits a heat to an outdoor air and thereby liquefied to be a refrigerant liquid. Thereafter, the high-pressure refrigerant liquid passes through the electronic expansion valve 4, is depressurized by the electronic expansion valve 4, and is rendered to be low-temperature low-pressure wet-vapor in a state of gas-liquid mixture. Further, the refrigerant passes through the liquid pipe 6, absorbs a heat of vaporization in the evaporator 7 to be a refrigerant gas, and passes through the gas pipe 10 and the returns to the compressor 1 in a state of gas.

In the next, natural circulation operation in a case that an outdoor air temperature is lower than an indoor temperature will be described. When the opening degree of the electronic expansion valve 4 is fully opened in order to reduce a pressure loss in the refrigerant circuit, the check valve 11 is released by a flow of refrigerant and a circuit for the natural circulation operation is formed. A liquid refrigerant condensed in the condenser 2 descends in the liquid pipe 6 by gravity and flows into the evaporator 7. The liquid refrigerant which flows into the evaporator 7 evaporates in receipt of an indoor thermal load. Thereafter, the refrigerant ascends in the gas pipe 10, passes through the check valve 11 in the compressor bypass pipe 12, and returns to the condenser 2.

Although the refrigerant can flow into a path passing through the compressor 1, a quantity of the refrigerant flow passing through the compressor 1 becomes small enough to be ignored with respect to a quantity of refrigerant flow passing through the compressor bypass pipe 12 because a fluid resistance of the inside of compressor is extremely larger than that of the compressor bypass pipe.

As described in the above, the air conditioner is constructed to be switchable between forced circulation operation and natural circulation operation in response to an outdoor air temperature and an indoor temperature, and power necessary for the natural circulation operation is input into the outdoor fan 3 and the indoor fan 8, whereby an annual power consumption can be drastically reduced. Further, in this air conditioner, it is possible to construct a simple unit at a low cost because two functions of pressure reduction which was carried out by the expansion valve 46 described in the prior air shown in FIG. 18 and of bypassing the expansion valve 46 which is carried out by the on-off valve 22 described in the above prior art, are realized by a single electronic expansion valve 4 of which opening degree can be externally controlled, whereby the three on-off valves 13, 22, 45 in the conventional unit are unnecessary.

Further, because it is possible to reduce the number of on-off valves necessary for switching over between the natural circulation operation and the forced circulation operation, it is possible to easily accommodate all components of the refrigerant circuit in the outdoor unit 5.

As the check valve 11 provided in the compressor bypass circuit 12, an electromagnetic on-off valve or the like can be used by opening it in the natural circulation operation and closing it in the forced circulation operation, whereby a similar effect to the above can be obtained. However, if the check valve 11 which enables a flow of refrigerant from the outlet of the evaporator 7 to the inlet of the condenser 2 and disables the back flow to pass therethrough, it is not necessary to open and close the valve in response to the natural circulation operation and the forced circulation operation, whereby a refrigerant circuit can be easily modified. In other words, when the forced circulation operation is performed, the check valve 11 is automatically closed by a pressure difference between a discharge pressure and a suction pressure. Further, when it is switched over to the natural circulation operation, a refrigerant is subject to a natural circulation in the refrigerant circuit by fully opening the opening degree of electronic expansion valve 4 and stopping the compressor 1, whereby the pressures applied to the both sides of the check valve 11 are inversely applied, whereby the check valve 11 is automatically opened.

Meanwhile, a flow rate of gas is generally larger than a flow rate of liquid when the same tube diameter and the same quantity of refrigerant flow are used. Therefore, a pressure loss in the gas pipe 10 becomes larger than a pressure loss in the liquid pipe 6. Since, in the natural circulation operation, the quantity of refrigerant flow is determined so that a pressure rise by an altitudinal difference is equal to a pressure loss in the refrigerant circuit, an increment of the pressure loss in the refrigerant circuit directly influences deterioration of cooling capability. Accordingly, cooling capability is enhanced by decreasing a pressure loss in a refrigerant circuit and increasing a quantity of refrigerant flow.

In the air conditioner according to Embodiment 1, it is possible to decrease a pressure loss in the refrigerant circuit and to increase a quantity of refrigerant flow because the pipe diameter of the gas pipe 10 for connecting the outlet of the evaporator 7 to the inlet of the condenser 2 is, for example, 1.5 through 2 times larger than the pipe diameter of the liquid pipe 6 for connecting the outlet of the condenser 2 to the inlet of the evaporator 7. Accordingly, deterioration of cooling capability in the natural circulation operation caused by an increment of pressure loss can be restricted.

Although the pipe diameter of the gas pipe 10 is, for example, 1.5 through 2 times larger than that of the liquid pipe 6, a degree of difference in the tube diameters is not limited thereto. As long as the gas pipe is wider than the liquid pipe 6, deterioration of cooling capability in the natural circulation operation can be avoided, wherein an effect of preventing the cooling capability from deteriorating is different to some extent in accordance with the degree of difference in the pipe diameters.

EMBODIMENT 2

Figure 2:
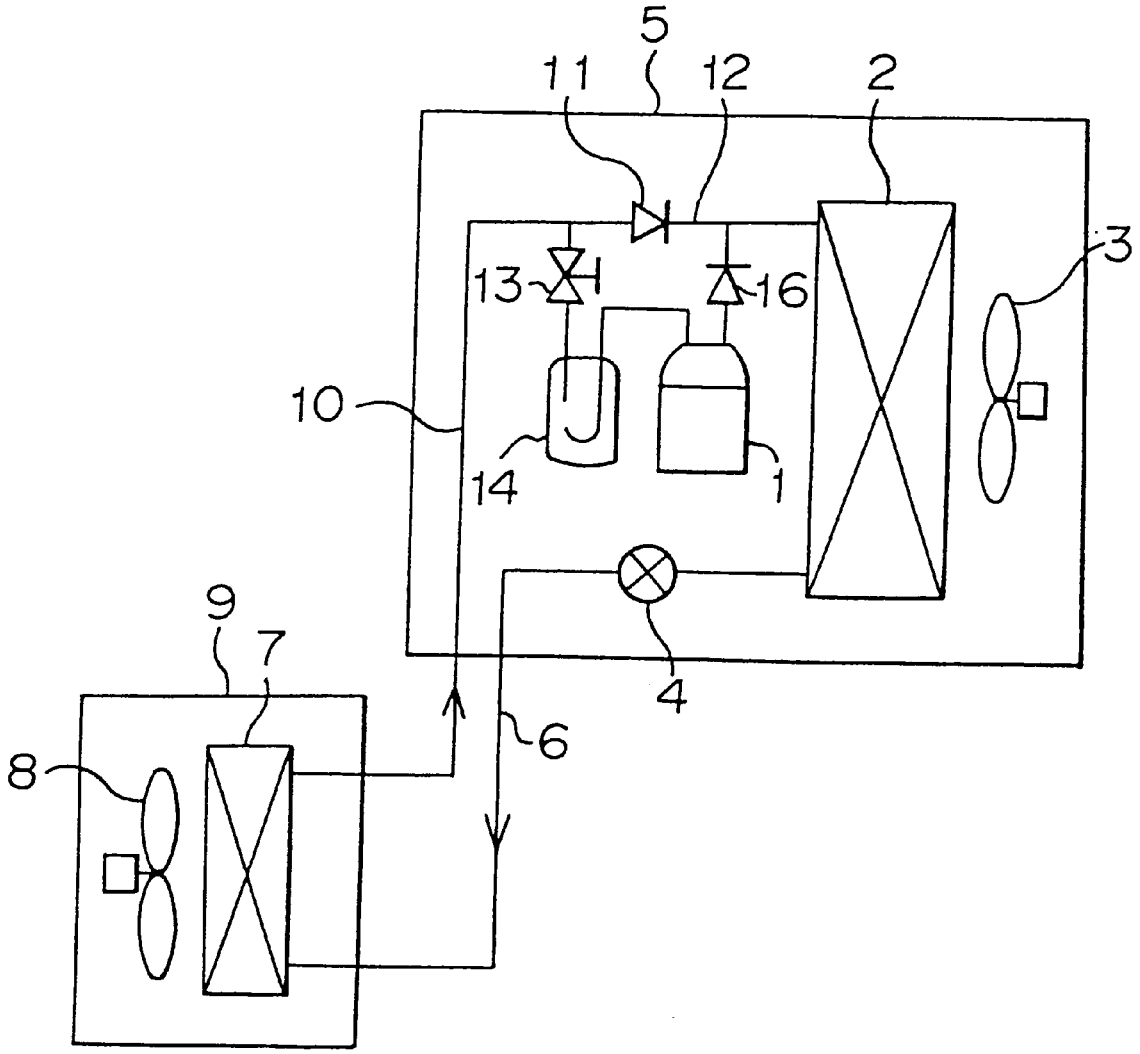
FIG. 2 schematically shows a structure of an air conditioner according to Embodiment 2 of the present invention.

Hereinbelow, an air conditioner, for example a cooling unit, according to Embodiment 2 of the present invention will be described. FIG. 2 shows a structure of the air conditioner according to this Embodiment. In the Figure, numerical reference 14 designates an accumulator for preventing a liquid from returning to a compressor 1 by a transient state or over charging of refrigerant, which accumulator is provided between an outlet of a compressor bypass pipe 12 and an inlet of the compressor 1. Numerical reference 13 designates an on-off valve (i.e. second on-off valve) for preventing a refrigerant from flowing into the accumulator 14, which valve is provided in a pipe between the inlet of the compressor bypass pipe 12 and an inlet of the accumulator 14. Numerical reference 16 designates an on-off valve (i.e. third on-off valve) provided in a pipe between an outlet of the compressor 1 and an outlet of the compressor bypass pipe 12, which valve is, for example, a check valve for enabling a refrigerant to flow from the outlet of compressor to the outlet of compressor bypass pipe 12 and disabling a refrigerant to backward flow. In the Figure, the same references as those in FIG. 1 designate portions same as or similar to those in FIG. 1, and an arrow designates a direction of refrigerant flow.

As in Embodiment 1, the air conditioner comprises an indoor unit 5, an outdoor unit 9, a liquid pipe 6 for connecting these units, and a gas pipe 10 for connecting the units.

The outdoor unit 5 includes the compressor 1 for compressing a refrigerant gas, a condenser 2 for cooling and liquefying this refrigerant gas, an outdoor fan for forcibly supplying an outdoor air to an outer surface of the condenser, an electronic expansion valve 4 for depressurizing a high-temperature high-pressure refrigerant liquid flowed out of the condenser 2 to render it wet-vapor in two-phase state, the accumulator 14 for preventing a liquid from returning to the compressor 1 by the transient state, overcharging of refrigerant or the like, the on-off valve 13 for bypassing the compressor 1 and the accumulator 14 at a time of the natural circulation operation, the compressor bypass pipe 12 in which a check valve 11 is interposed, and a check valve 16 for preventing a refrigerant which flows through the compressor bypass pipe 12 at a time of the natural circulation operation from flowing into the compressor.

The indoor unit 5 includes an evaporator 7 for evaporating wet-vapor flowed from a liquid pipe 6 by an indoor air conditioning load in a space to be air-conditioned, and an indoor fan 8 for forcibly supplying an indoor air to an outer surface of the evaporator 7.

In this air conditioner, when the forced circulation operation is performed, the on-off valve 13 is opened and an opening degree of the electronic expansion valve 4 is set to be a degree appropriate for reducing pressure of a refrigerant liquid flowed out of the condenser 2 and render the refrigerant liquid wet-vapor in two-phase state, for example about 15% of the full opening, in running the compressor 1. Under such a running condition, the check valve 11 in automatically closed by a pressure difference between a discharge pressure and a suction pressure of the compressor 1, and the check valve 16 is automatically opened, whereby a circuit for the forced circulation operation is formed.

Incidentally, when the natural circulation operation is performed, by stopping the compressor 1 and closing the on-off valve 13 at substantially simultaneous timing, and further the opening degree of the electronic expansion valve 4 is made full, the check valve 11 is released by a flow of refrigerant, whereby a circuit for the natural circulation operation is formed.

If the forced circulation operation is further performed, the on-off valve 13 is closed at first hand; the opening degree of the electronic expansion valve 4 is choked; and the compressor 1 is run at substantially simultaneous timing.

Figure 18:
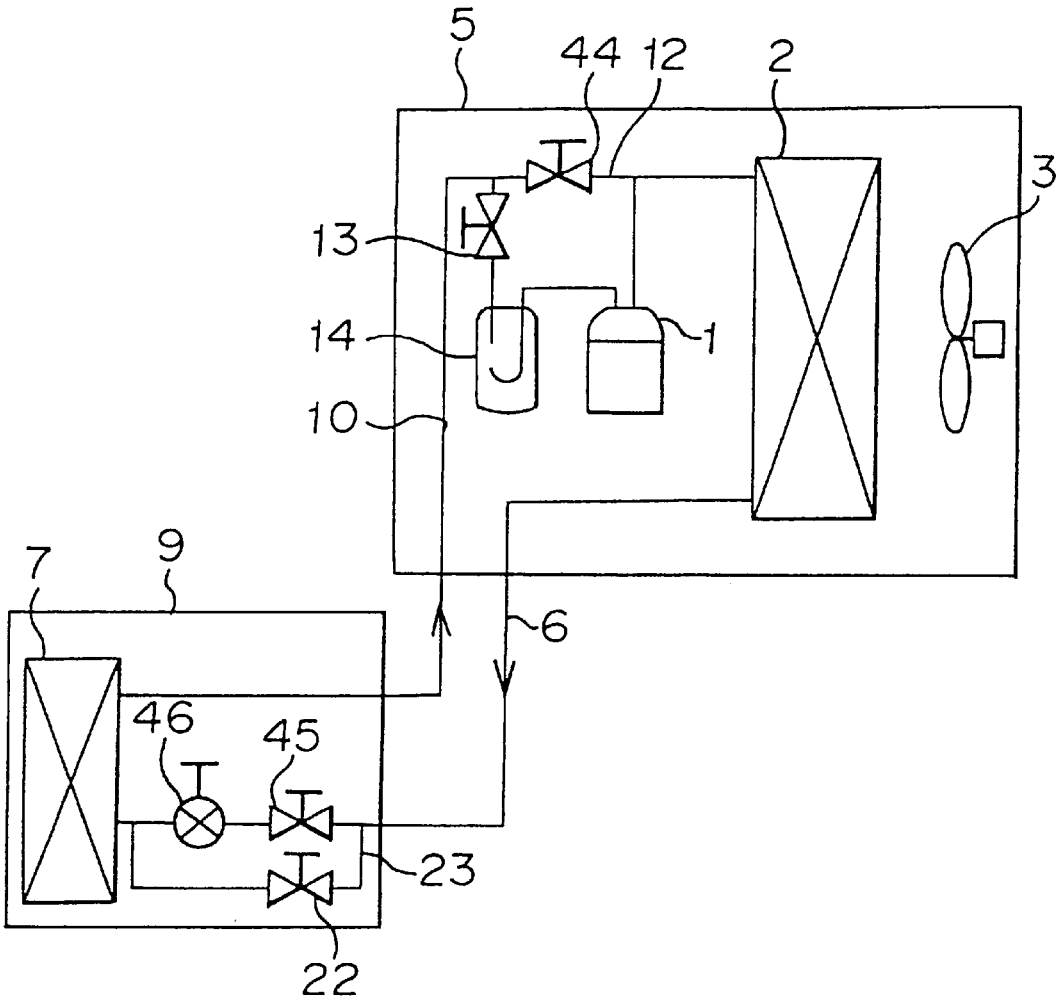
FIG. 18 schematically shows a structure of a conventional air conditioner using both of natural circulation operation and forced circulation operation.

In this air conditioner, the two functions of the depressurizing function by the expansion valve 46 and of bypassing the expansion valve 46 by the on-off valve 22, both disclosed in the prior art shown in FIG. 18, are realized by a single electronic expansion valve 4 of which opening degree can be externally controlled, wherein a simple unit can be constructed at a low cost because the two valves 22, 45 in the conventional device become unnecessary.

Further, it is possible to easily accommodate all components of the refrigerant circuit in the outdoor unit 5 because the number of on-off valves necessary for switching between the natural circulation operation and the forced circulation operation is reduced.

Additionally, the check valve 11 provided in the compressor bypass circuit 12 can be an electromagnetic on-off valve or the like. However, when it is a check valve enabling a refrigerant to flow from the outlet of the evaporator 7 to the inlet of the condenser 2 and disabling it to backward flow, it is not necessary to open and close in response to the natural circulation operation and the forced circulation operation, whereby the refrigerant circuit can be easily changed.

Meanwhile, in accordance with a condition of refrigerant in the refrigerant circuit, a quantity of refrigerant necessary for the natural circulation operation is larger than that for the forced circulation operation. In this Embodiment, because the accumulator 14 is provided in the pipe between the inlet of the compressor bypass pipe 12 and the inlet of the compressor 1, it is possible to absorb an excessive refrigerant generated at the time of forced circulation operation.

Further, although it is necessary to prevent a refrigerant from accumulating in the refrigerant circuit at the time of natural circulation operation as much as possible, a refrigerant is apt to flow into the accumulator 14 after switching to the natural circulation operation because the accumulator 14 is positioned in the outdoor unit 5 as in this air conditioner, the inside of accumulator 14 is in a state of low-temperature and low-pressure during the forced circulation operation. Therefore, the air conditioner according to this Embodiment, the on-off valve 13 is provided in the pipe between the inlet of the compressor bypass pipe 12 and the outlet of the accumulator. Accordingly, it is possible to prevent a refrigerant from flowing into the accumulator 14 by closing the on-off valve 13 at the time of switching over from the forced circulation operation to the natural circulation operation, whereby a quantity of the refrigerant necessary for the natural circulation operation can be secured, wherein stable cooling capability is always obtainable.

Additionally, in Embodiment 2, the check valve 16 is provided in the pipe between the outlet of the compressor 1 and the outlet of the compressor bypass pipe 12. Just after switching over from the forced circulation operation to the natural circulation operation, a refrigerant does not ordinarily flow from the outlet of the compressor bypass pipe 12 to the outlet of the compressor because the temperature of the compressor 1 is maintained to be higher than a refrigerant saturation temperature at the time of natural circulation operation by thermal capacity of the compressor itself. However, when an outdoor air temperature is low as in a winter season, cooling capability obtainable by the natural circulation operation is increased, whereby the compressor 1 is in a state of stopping for a long time and the temperature of the compressor 1 is decreased along with a lapse of time. In such a case, because a quantity of refrigerant necessary for the natural circulation operation is not secured because a refrigerant gradually condenses from the refrigerant circuit of the natural circulation to the compressor 1, there is a possibility that a breakage happens by a generation of liquid compression when the compressor 1 is started up. In the air conditioner according to Embodiment 2, the check valve 16 is provided between the outlet of the compressor 1 and the outlet of the compressor bypass pipe. Because most part of a refrigerant flows through the compressor bypass pipe 12 in the natural circulation operation, a pressure difference occurs between both ends of the check valve 16 and thereby the check valve is automatically closed. Therefore, even when the compressor 1 is in a stopped state for a long time, it is possible to prevent a refrigerant from flowing into the compressor 1 and condensing therein; a quantity of refrigerant necessary for the natural circulation operation can be secured; and reliability of the compressor 1 can be improved.

In addition, when the check valve 16 is an electromagnetic on-off valve or the like, it can be operated to be opened in the forced circulation operation and to close in the natural circulation operation to realize a similar effect thereto. However, as in the above Embodiment, when a check valve allowing a flow of refrigerant from the outlet of compressor 1 to the outlet of compressor bypass pipe 12 and stopping the back flow is used, the valve automatically opens and closes by a pressure difference between the both sides, whereby it is not necessary to open and close in response to the natural circulation operation and the forced circulation operation and to surely stop condensation of a refrigerant into the compressor 1 under the natural circulation operation.

In addition, the on-off valve 16 can be provided in the pipe between the outlet of compressor 1 and the outlet of compressor bypass pipe 12 in the air conditioner having the structure shown in FIG. 18. In this structure, as described in the above, it is possible to prevent a refrigerant from flowing into the compressor 1 and condensing, to secure a quantity of refrigerant necessary for the natural circulation operation and to improve reliability of the compressor 1.

EMBODIMENT 3

Figure 3:
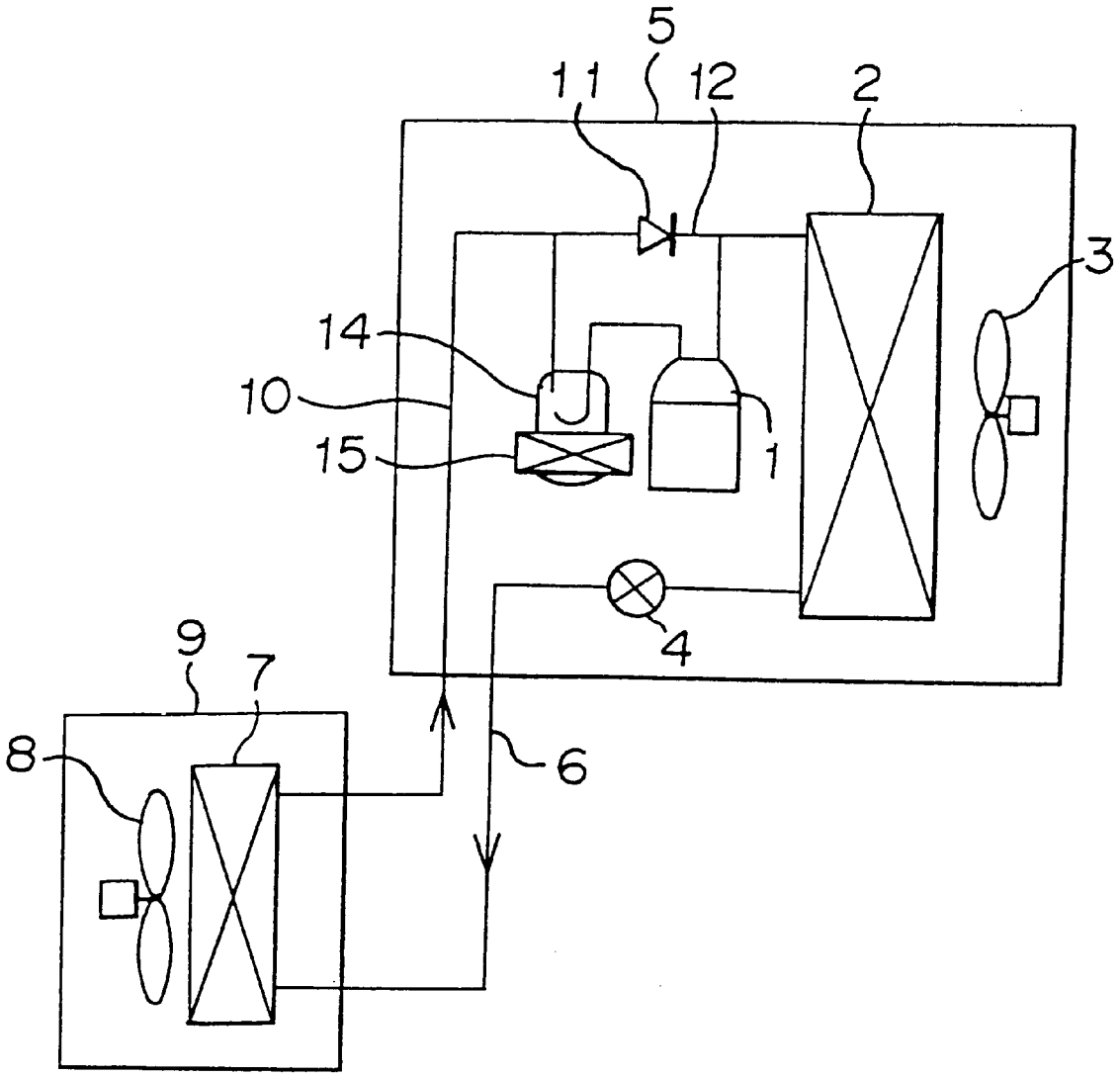
FIG. 3 schematically shows a structure of an air conditioner according to Embodiment 3 of the present invention.

Hereinbelow, an air conditioner, for example, a cooling unit, according to Embodiment 3 of the present invention will be described. FIG. 3 shows a structure of the air conditioner according to Embodiment 3. In FIG. 3, numerical reference 15 designates a heating means for heating a refrigerant in an accumulator, for example a heater. The same references as those in FIG. 1 designate portions the same as or similar to those in FIG. 1. Further, in FIG. 3, an arrow designates a direction of refrigerant flow.

As in Embodiment 1, an outdoor unit 5, an indoor unit 9, a liquid pipe 6 for connecting these units, and a gas pipe 10 for connecting the units constitute the air conditioner.

The outdoor unit 5 includes a compressor 1 for compressing a refrigerant gas, a condenser 2 for cooling and liquefying this refrigerant gas, an outdoor fan for forcibly supplying an outer air to an outer surface of the condenser 2, an electronic expansion valve 4 for depressurizing a high-temperature high-pressure refrigerant liquid out of the condenser 2 and rendering it wet-vapor in a two-phase state, an accumulator 14 for preventing a liquid from returning to the compressor by a transient state, overcharging of a refrigerant, or the like, a compressor bypass pipe 12 provided with a check valve 11 for bypassing the compressor 1 and the accumulator 14 in the natural circulation operation, and the heater 15 for heating and evaporating an excessive refrigerant in the accumulator 14.

Further, the indoor unit 5 includes an evaporator for evaporating the wet-vapor flowed from the liquid pipe 6 by an indoor air conditioning load in a space to the air-conditioned, and an indoor fan 8 for forcibly supplying an indoor air to an outer surface of the evaporator 7.

In this air conditioner, when forced circulation operation is performed, the compressor 1 is run by setting an opening degree of the electronic expansion valve 4 to be a degree appropriate for depressurizing a refrigerant liquid out of the condenser 2 and rendering it wet-vapor in a two-phase state, for example about 15% of the full opening degree, whereby the check valve is closed by a pressure difference between a discharge pressure and a suction pressure of the compressor to thereby form a circuit for the forced circulation operation. Meanwhile, when the natural circulation operation is performed, the compressor 1 is stopped and the electronic expansion valve 4 is fully opened, whereby the check valve 11 is released by a flow of refrigerant to thereby form a circuit for the natural circulation operation.

As described in Embodiment 2, because a requisite quantity of refrigerant is larger in the natural circulation operation than that in the forced circulation operation, it is necessary to prevent a refrigerant from accumulating in a refrigerant circuit in the natural circulation operation. However, when the accumulator 14 is located in the outdoor unit 5, a refrigerant flows into the accumulator 14 after switching over from the forced circulation operation to the natural circulation operation. Therefore, in Embodiment 3, a drop of temperature of the accumulator 14 is restricted by stopping the compressor 1 and simultaneously starting an application of electricity to the heater 15. In this case, although just after the switching over, a refrigerant flows into the accumulator 14, a refrigerant liquid evaporates to be a refrigerant gas by heating a refrigerant liquid accumulating in the accumulator 14 by the heater 15, whereby the refrigerant gas mainly passes through the inlet pipe of the accumulator 14 and returns to the refrigerant circuit of the natural circulation operation.

As described, in Embodiment 3, the heater 15 is provided in order to heat and evaporate a refrigerant liquid in the accumulator 14. Because it is possible to prevent a refrigerant from flowing from the gas pipe 10 to the accumulator 14 in the natural circulation operation, a quantity of refrigerant necessary for the natural circulation operation can be secured. Further, because the on-off valve 13 for preventing a refrigerant from accumulating in the accumulator 14 shown in FIG. 2 becomes unnecessary, it is possible to constitute a simple device at a low cost.

Additionally, an electric energy input in the heater 15 is sufficient to be an extent for maintaining a temperature of the accumulator 14 a refrigerant saturation temperature or more at the time of natural circulation operation and is smaller than an electric energy input in the compressor 1 necessary for a refrigerant recovery operation. Therefore, annual power consumption can be reduced.

Electric power input into the heater 15 may be supplied by a predetermined quantity simultaneously with stopping of the compressor or the quantity and a time of applying of such electric power may be calculated based on a detected value obtained by a thermal sensor or a pressure sensor provided in a pipe of the inlet and the outlet of the accumulator. It is also preferable to on and off the application of the electric power by detecting a quantity of liquid refrigerant in the accumulator 14. Further, it is preferable to maintain the temperature of accumulator 14 high while continuously applying an electricity to the heater 15. In such a case, although consumption of the electric power increases to a certain extent, it is possible to reduce annual power consumption as a whole because a liquid refrigerant does not accumulate in the accumulator 14 and thereby refrigerant recovery operation becomes unnecessary.

EMBODIMENT 4

Figure 4:
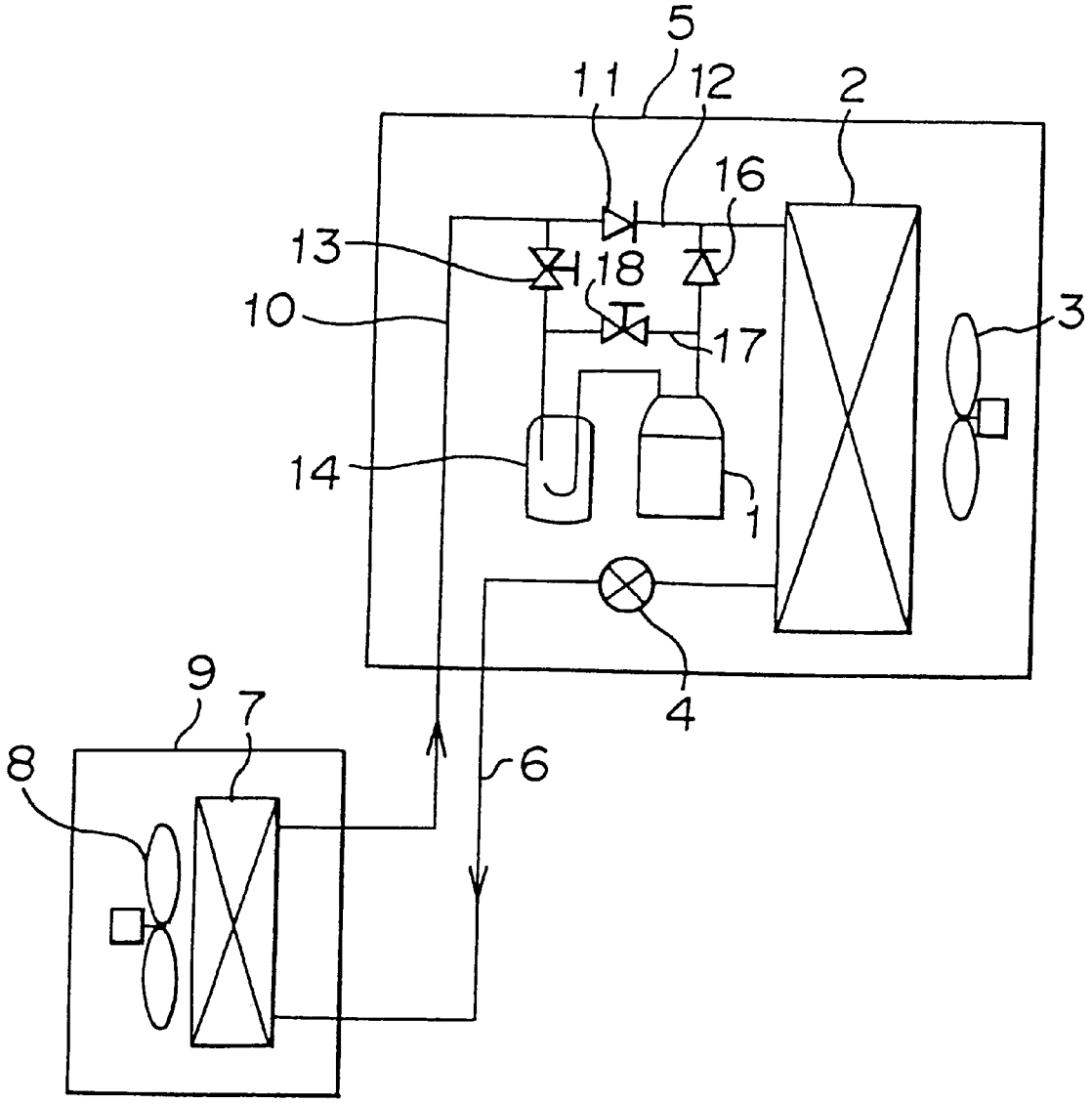
FIG. 4 schematically shows a structure of an air conditioner according to Embodiment 4 of the present invention.

Hereinbelow, an air conditioner, for example a cooling device, in accordance with Embodiment 4 of the present invention will be described. FIG. 4 shows a structure of the air conditioner according to this Embodiment. In the Figure, numerical reference 17 designates a bypass pipe provided with an on-off valve (i.e. fourth on-off valve) 18 for connecting a high-pressure tube at an outlet of a compressor 1 and an inlet of an accumulator 14. The same references as in FIG. 1 designate portions the same as or similar to those in FIG. 1. In FIG. 4, an arrow designates a direction of refrigerant flow.

As described in Embodiment 1, the air conditioner according to Embodiment 4 includes an outdoor unit 5, an indoor unit 9, a liquid pipe 6 for connecting these units, and a gas pipe 10 for connecting the units.

The outdoor unit 5 includes a compressor 1 for compressing a refrigerant gas, a condenser 2 for cooling and liquefying this refrigerant gas, an outdoor fan 3 for forcibly supplying an outer air to an outer surface of the condenser 2, an electronic expansion valve 4 for depressurizing a high-temperature high-pressure refrigerant liquid out of the condenser 2 and rendering it wet-vapor of a two-phase state, the accumulator 14 for preventing a liquid from returning to the compressor 1 by a transient state, overcharging of a refrigerant or the like, an on-off valve 13 for bypassing the compressor 1 and the accumulator 14 in natural circulation operation, a compressor bypass pipe 12 provided with a check valve 11, a check valve 16 for preventing a refrigerant from flowing into the compressor 1 in the natural circulation operation, and a bypass tube 17 provided with an on-off valve 18 for connecting a high-pressure tube at the outlet of compressor 1 and a low-pressure tube at the inlet of accumulator 14.

Further, the indoor unit 9 includes an evaporator 7 for evaporating the wet-vapor flowed from the liquid pipe 6 by an air conditioning load, and an indoor fan 8.

Figure 5:
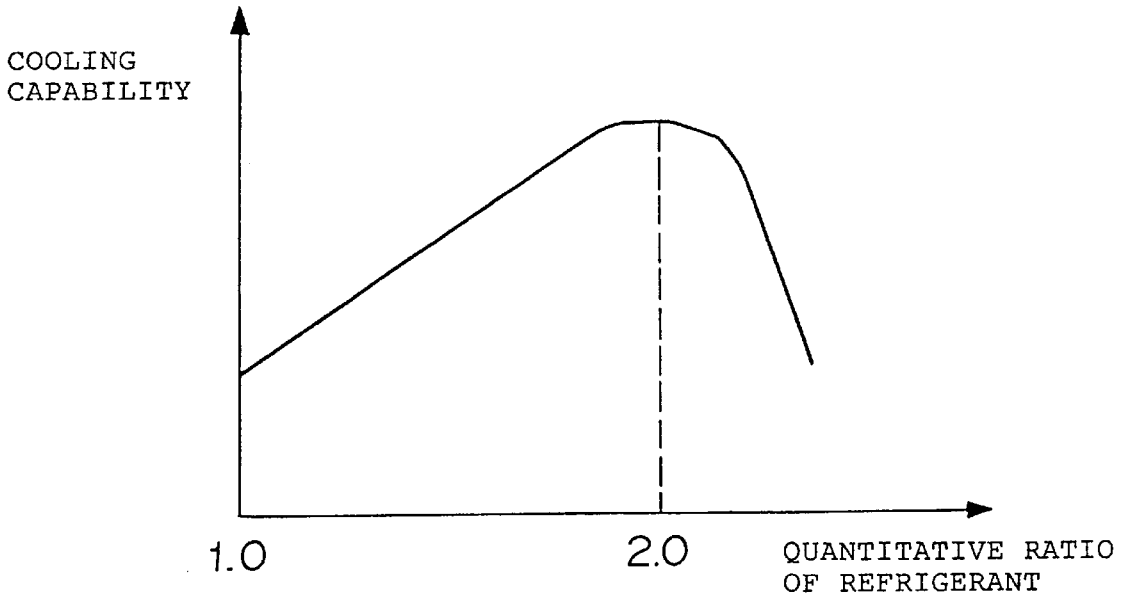
FIG. 5 is a characteristic diagram for showing cooling capability with respect to a ratio of the quantity of refrigerant to be charged in an air conditioner according to Embodiment 4.

FIG. 5 shows a result of test for showing a variation of cooling capability in a case that a quantity of charged refrigerant is varied in the natural circulation operation, wherein an abscissa designates a quantitative ratio of refrigerant in the natural circulation operation with respect to an appropriate quantity of refrigerant in the forced circulation operation, and an ordinate designates cooling capability. As shown in FIG. 5, it is known that in order to maximize the cooling capability of natural circulation operation, a quantity of refrigerant should be charged about two times as much as a quantity of refrigerant for the forced circulation operation. Accordingly, when the quantity of refrigerant of maximizing the cooling capability of the natural circulation operation is charged, an excessive refrigerant is stored in the accumulator 14 in the forced circulation operation. Therefore, in switching over the operations, it is necessary to conduct refrigerant recovery operation to return this excessive refrigerant to a refrigerant circuit of the natural circulation operation.

As for the refrigerate recovery operation, there is a method of conducting forced circulation operation by completely closing the electronic expansion valve 4. However, by this method, because a suction pressure of the compressor 1 is abruptly reduced, a refrigerating machine oil flows into a refrigerant circuit along with a discharge gas which is generated by gassing of a refrigerant liquid intaken in the compressor 1 and a quantity of refrigerating machine oil in the compressor 1 is decreased, whereby there is a possibility that seizure is caused by insufficient lubrication. Specifically, in a case of a scroll compressor, a quantity of oil supplied to a sliding portion is decreased by a reduced suction pressure or gassing of a refrigerant in the compressor 1 and thereby the sliding portion is subjected to heat distortion by the increased temperature and is finally broken. Further, the refrigerating machine oil flowed into a refrigerating circuit causes an increment of pressure loss and thereby the cooling capability of the natural circulation operation is deteriorated. It is an object of Embodiment 4 to improve reliability at a time of the above refrigerant recovery operation and cooling capability at a time of natural circulation operation.

Figure 6:
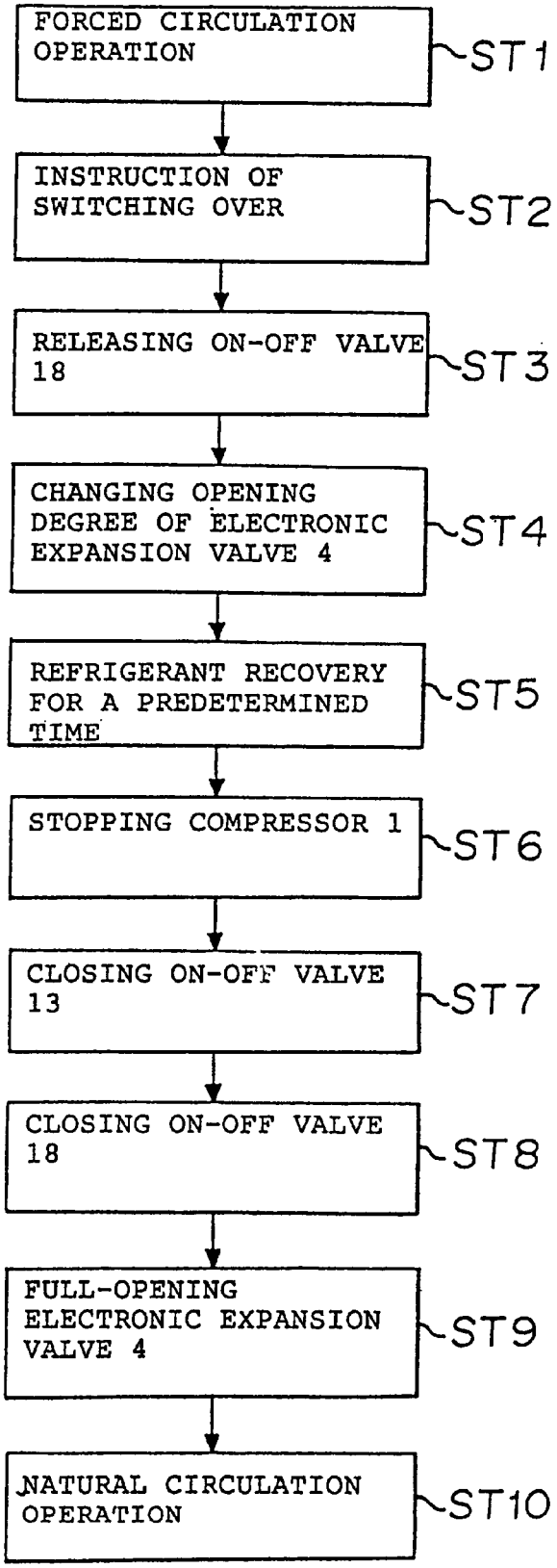
FIG. 6 is a flow chart for explaining a procedure of switching over from forced circulation operation to natural circulation operation in an air conditioner according to Embodiment 4 of the present invention.

FIG. 6 is a flow chart for explaining a procedure for switching over from the circulation operation to the natural circulation operation. In a step of ST1, the forced circulation operation is performed, wherein the on-off valve 13 is opened; the on-off valve 18 is closed; and an opening degree of the electronic expansion valve 4 is set in a state appropriate for depressurizing a refrigerant liquid out of the condenser 2 and rendering it wet-vapor of a two-phase state, for example about 15% of the full opening degree. In a step of ST2, an instruction of switching over the operations is received. In a step of ST3, the on-off valve 18 is released. In a step of ST4, an opening degree of the electronic expansion valve 4 is changed to an opening degree for causing a super heat state in the outlet of the evaporator 7, for example about 10% of the full opening degree, and thereafter refrigerant recovery operation is performed for example for a predetermined time in a step of ST5. In the refrigerant recovery operation (ST5), a refrigerant liquid in the accumulator 14 is evaporated by a super heated gas from the evaporator 7 and a super heated gas discharged from the compressor 1 through the bypass pipe 17 provided with the on-off valve 18. Thus, the excessive refrigerant is recovered on a side of the condenser 2 after passing through the compressor 1 and the check valve 16.

In the next, in a step of ST6, the compressor 1 is stopped. In a step of ST7, the on-off valve 14 is closed to prevent a refrigerant from flowing into the accumulator 14. In a step of ST8, the on-off valve 18 is closed and an opening degree of the electronic expansion valve 4 is changed to be a full opened state to reduce a pressure loss in a refrigerant circuit in a step of ST9. Thereafter, the natural circulation operation will be performed in a step of ST10.

In the refrigerant recovery operation (ST5), a part of a high-temperature high-pressure super heated gas discharged from the compressor 1 is branched to the inlet side after passing through the on-off valve 18 provided in the bypass pipe 17. Accordingly, it is possible to recover a refrigerant stored in the accumulator 14 into the natural circulation circuit without reducing a suction pressure of the compressor 1.

In addition, although the refrigerant recovery operation is performed for a predetermined time in the step of ST5, it is also possible to perform the refrigerant recovery operation such that a suction temperature, a discharge temperature, a heating rate in suction, and a heating rate in discharge are detected and the operation is continued until these detected values become predetermined values.

There is an effect that a refrigerant stored in the accumulator 14 can be recovered within a cycle of the natural circulation operation without reducing a suction pressure of the compressor 1 by providing the bypass pipe 17 connecting the high-pressure pipe to the low-pressure pipe interposing the on-off valve 18 and switching over the operation in accordance with the procedure shown in FIG. 6, whereby reliability of the compressor 1 can be improved.

Additionally, a position of connecting the bypass pipe 17 is not limited to the above-mentioned position and, as long as it connects the high-pressure pipe between the outlet of compressor 1 and the inlet of condenser 2 to the low-pressure pipe between the outlet of expansion valve 4 and the inlet of compressor 1, a similar effect to that described in the above is obtainable.

EMBODIMENT 5

Figure 7:
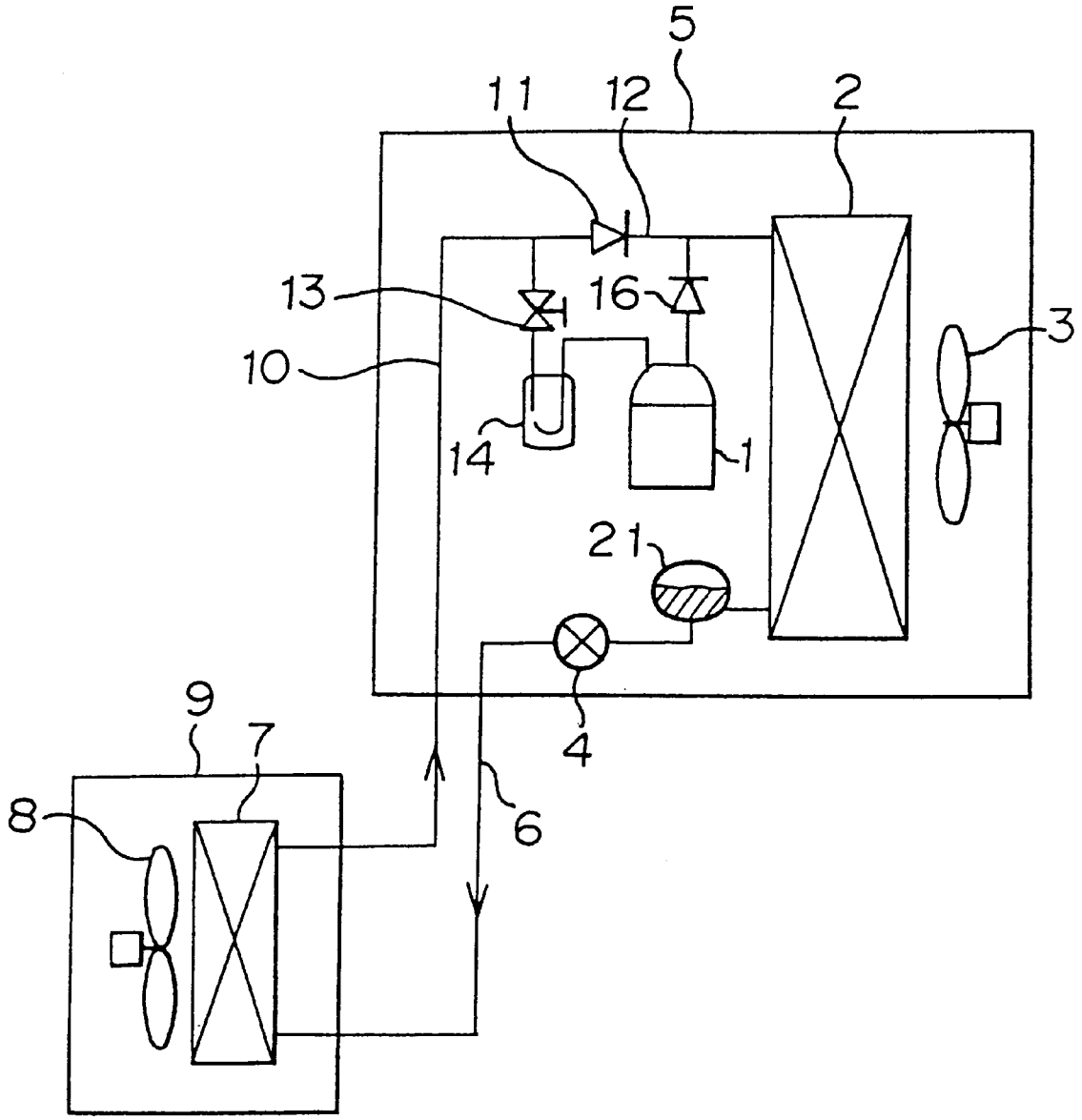
FIG. 7 schematically shows a structure of an air conditioner according to Embodiment 5 of the present invention.

Hereinbelow, an air conditioner, for example a cooling device, according to Embodiment 5 of the present invention will be described. FIG. 7 shows a structure of the air conditioner according to Embodiment 5. In FIG. 7, numerical reference 21 designates a liquid receiver provided in a pipe between an outlet of a condenser 2 and an inlet of an electronic expansion valve to store a refrigerant liquid flowing out of the condenser 2. The same references as those in FIG. 1 designate portions the same as or similar to those in FIG. 1. An arrow in FIG. 7 designates a direction of refrigerant flow.

As in Embodiment 1, the air conditioner according to Embodiment 5 includes an outdoor unit 5, an indoor unit 9, a liquid pipe 6 for connecting these units, and a gas pipe 10 for connecting the units.

The outdoor unit 5 includes a compressor 1 for compressing a refrigerant gas, the condenser 2 for cooling and liquefying this refrigerant gas, an outdoor fan for forcibly supplying an outer air to an outer surface of the condenser 2, the electronic expansion valve 4 for depressurizing a high-temperature high-pressure refrigerant liquid out of the condenser 2 and rendering it wet-vapor of a two-phase state, an accumulator 14 preventing a liquid from returning to the compressor 1 by a transient state, overcharging of a refrigerant or the like, an on-off valve 13 for bypassing the compressor 1 and the accumulator 14, a compressor bypass pipe 12 between which a check valve 11 is intermediate, a check valve 16 for preventing a refrigerant from flowing into the compressor 1 in natural circulation operation, and the liquid receiver 21 for storing a refrigerant liquid flowed out of the outlet of condenser 2.

Further, the indoor unit 9 includes an evaporator 7 for evaporating the wet-vapor flowed from the liquid pipe 6 by an air conditioning load, and an indoor fan 8.

The liquid receiver 21 is arranged in a lower portion of the condenser 2, and a pipe for introducing a refrigerant from the condenser 2 and a pipe for sending it to the electronic expansion valve 4 are connected to a lower portion of the liquid receiver 21. Further, the liquid receiver 21 has a capacity for accommodating a refrigerant liquid corresponding to a difference between an appropriate refrigerant quantity in forced circulation operation and that in the natural circulation operation.

In this air conditioner, when the forced circulation operation is performed, an opening degree of the electronic expansion valve 4 is appropriate for depressurizing a refrigerant liquid flowed out of the condenser 2 and rendering it wet-vapor of a two-phase state, for example about 15% of the full opening degree, and the compressor is run. The check valve 11 is closed by a pressure difference between a discharge pressure and a suction pressure of the compressor 1, whereby a circuit for the forced circulation operation is formed. At this time, a refrigerant liquid, of which quantity corresponds to the difference between an appropriate refrigerant quantity in the forced circulation operation and that in the natural circulation operation, is stored in the liquid receiver 21.

Further, when the natural circulation operation is performed, the on-off valve 13 is closed and an opening degree of the electronic expansion valve 4 is full, whereby the check-valve 11 is released by a flow of refrigerant, wherein a circuit for the natural circulation operation is formed.

As described in Embodiment 4, when a quantity of refrigerant, around which cooling capability of the natural circulation operation is maximum, is charged, an excessive refrigerant is stored in the accumulator 14 in the natural circulation operation. Accordingly, at a time of switching over the operations, this excessive refrigerant should be returned to a refrigerant circuit for the natural circulation operation by refrigerant recovery operation. Because the air conditioner according to Embodiment 5 has the liquid receiver 21 provided around the outlet of the condenser 2, the excessive refrigerant is stored in the condenser 2 at the time of forced circulation operation and therefore it is possible to prevent a heat transmission area effective for condensation from reducing. Further, because the excessive refrigerant is accumulated in the liquid receiver 21, it is possible to prevent the excessive refrigerant from accumulating in the accumulator 14, whereby the accumulator 14 can be miniaturized or omitted. Additionally, because the excessive refrigerant does not accumulated in the accumulator, refrigerant recovery operation becomes unnecessary and the bypass pipe 17, between which the electromagnetic valve 18 is intermediate described in Embodiment 4, can be omitted.

EMBODIMENT 6

Hereinbelow, an air conditioner, for example a cooling device, according to Embodiment 6 of the present invention will be described.

Figure 8:
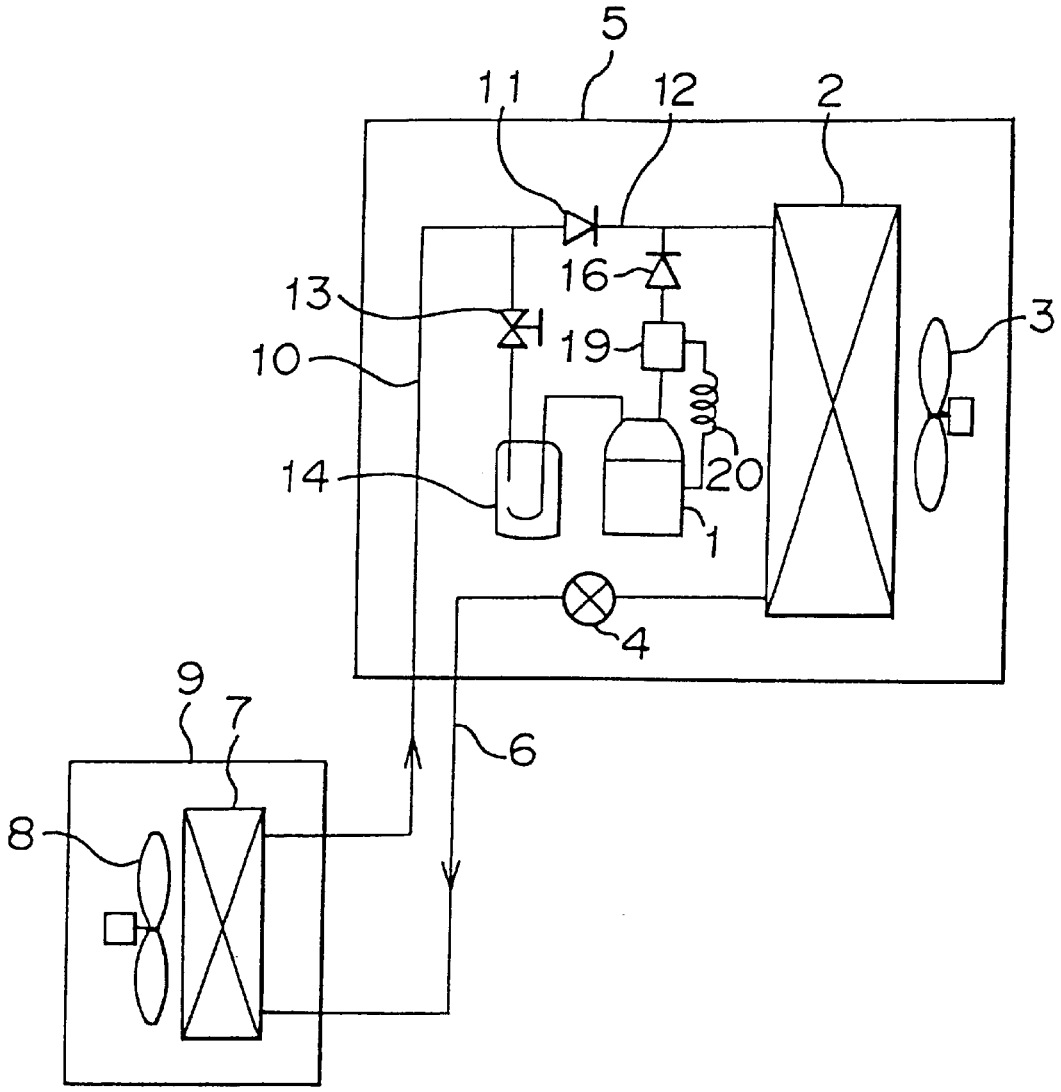
FIG. 8 schematically shows a structure of an air conditioner according to Embodiment 6 of the present invention.

FIG. 8 shows a structure of the air conditioner according to Embodiment 6. In FIG. 8, numerical reference 19 designates an oil separator for separating a refrigerating machine oil discharged along with a refrigerant gas from a compressor 1 and returning the oil to the compressor 1, which separator is provided in a pipe between an outlet of the compressor 1 and an inlet of a condenser 2. Numerical reference 20 designates a capillary vessel for returning the refrigerating machine oil separated by the oil separator 19 to the compressor 1. The same reference as those in FIG. 1 designate portions the same as or similar to those in FIG. 1. In FIG. 8, an arrow designates a direction of refrigerant flow.

As disclosed in Embodiment 1, the air conditioner includes an outdoor unit 5, an indoor unit 9, a liquid pipe 6 for connecting these units, and a gas pipe 10 for connecting the units.

The outdoor unit 5 includes the compressor 1 for compressing a refrigerant gas, the condenser 2 for cooling and liquefying this refrigerant gas, an outdoor fan 3 for forcibly sending an outdoor air to an outer surface of the condenser 2, an electronic expansion valve 4 for depressurizing a high-temperature high-pressure refrigerant liquid out of the condenser 2 and rendering it wet-vapor of a two-phase state, an accumulator 14 for preventing a liquid from returning to the compressor 1 by a transient state, overcharging of a refrigerant or the like, an on-off valve 13 for bypassing the compressor 1 and the accumulator 14, a compressor bypass pipe 12 between which a check valve 11 is intermediate, a check valve 16 for preventing a refrigerant from flowing into the compressor 1 in natural circulation operation, the oil separator 19 for separating a refrigerating machine oil discharged along with a refrigerant gas from the compressor 1 and returning to the compressor, and the capillary vessel 20 for returning the refrigerating machine oil separated by the oil separator 19 to the compressor 1.

The indoor unit 9 includes an evaporator 7 for evaporating the wet-vapor flowed from the liquid pipe 6 by an air conditioning load, and an indoor fan 8.

In this air conditioner, when forced circulation operation is performed, an opening degree of the electronic expansion valve 4 is set to be an appropriate opening degree so that a refrigerant liquid flowed out of the condenser 2 is depressurized to be wet-vapor of a two-phase state, for example about 15% of the full opening degree, and the compressor 1 is run. Thus, the check valve 11 is closed by a pressure difference between a discharge pressure and a suction pressure of the compressor 1 and therefore a cycle of the forced circulation operation is formed. At this time, refrigerant gas discharged from the compressor 1 passes through the oil separator 19 and a refrigerating machine oil in the refrigerant gas is separated. Thereafter, it flows into the condenser 2. The refrigerating machine oil separated by the oil separator 19 is depressurized in the capillary vessel 20 and is returned to the compressor 1.

Meanwhile, when the natural circulation operation is performed, the on-off valve 13 is closed and an opening degree of the electronic expansion valve 4 is full. Then, the check valve 11 is released by a flow of refrigerant, whereby a cycle of the natural circulation operation is formed.

In general, a refrigerating machine oil flowing out of the compressor 1 along with the discharge gas at a time of forced circulation operation can not return to the compressor at a time of natural circulation operation because the compressor 1 is bypassed by the on-off valve 13 and the check valve 16. Therefore, the refrigerating machine oil circulates in a refrigerant circuit. A refrigerating machine oil circulating along with a refrigerant in a refrigerant circuit causes influences such that a reduction of heat transmission ratio and an increase of pressure loss. Particularly, in the natural circulation operation, because a quantity of refrigerant flow is smaller than that in the forced circulation operation, a thickness of oil film attached to a wall surface of the gas pipe 10 as a rising pipe is increased, whereby a pressure loss of a refrigerant circuit is increased and cooling capability is deteriorated.

In the air conditioner according to Embodiment 6, because the oil separator 19 is installed in the outlet of compressor 1 and it is constructed such that a refrigerating machine oil discharged along with a refrigerant gas is separated and returned to the compressor 1, it is possible to restrict deterioration of cooling capability caused by a refrigerating machine oil circulating in a refrigerant circuit in the natural circulation operation. Additionally, it is possible to restrict a phenomenon that a refrigerating machine oil in the compressor 1 flows into a refrigeration circuit, a quantity of refrigerating machine oil in the compressor 1 is reduced, and the compressor is seized by such insufficient lubrication, whereby there is an effect that reliability of the compressor 1 is improved. Particularly, in a case of particular, a non-compatible oil such as alkylbenzene having a small solubility with respect to a refrigerant separated from the refrigerant in the condenser 2, the evaporator 7, and the liquid pipe 6, it may be affected by a reduction of heat transmission ratio or an increment of pressure loss. In such a case, the air conditioner according to Embodiment 6 can provide an improvement in comparison with a case of using a refrigerating machine oil such as a mineral oil compatible with a refrigerant.

EMBODIMENT 7

Hereinbelow, an air conditioner, for example a cooling device, according to Embodiment 7 of the present invention will be described.

Figure 9:
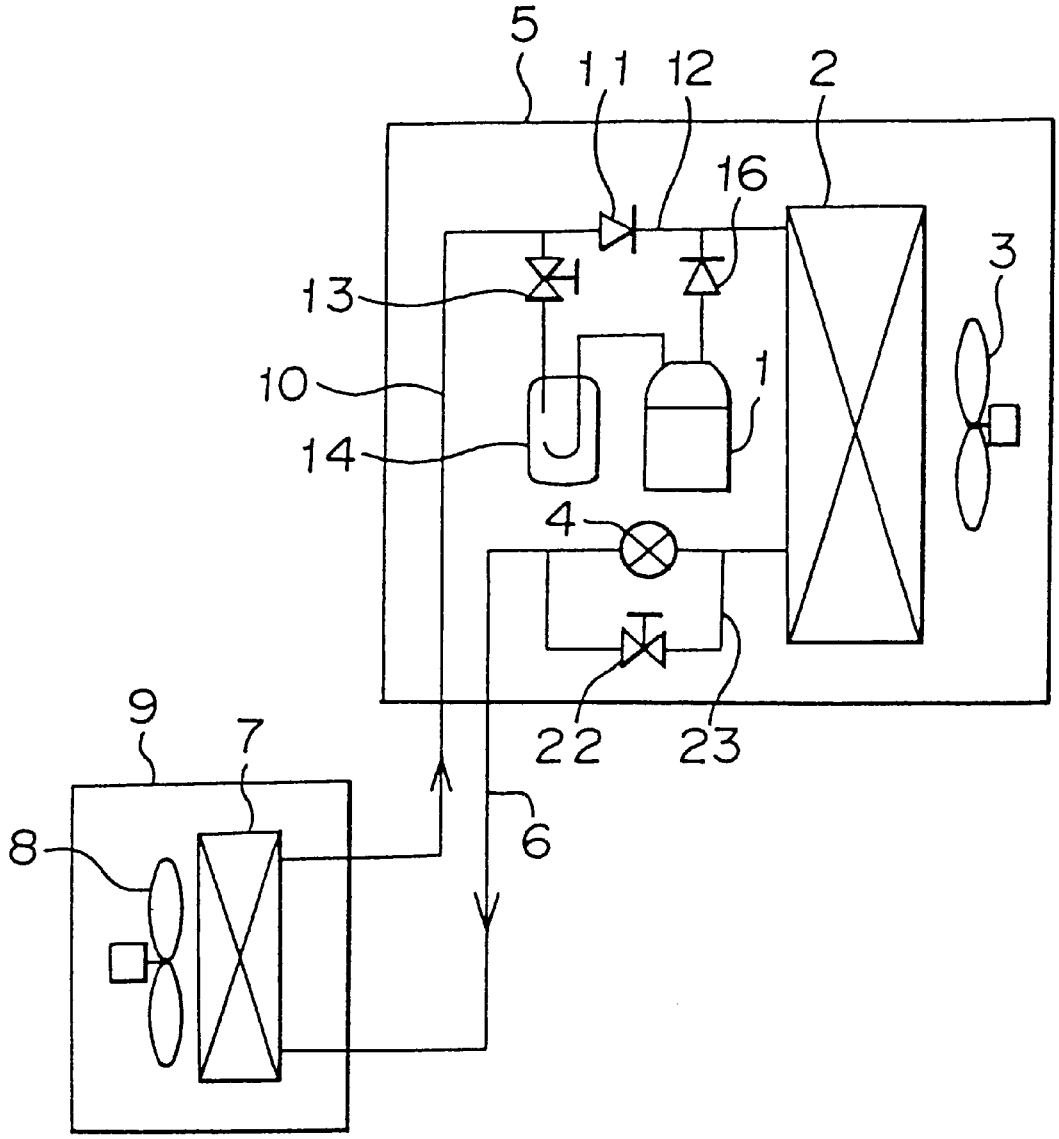
FIG. 9 schematically shows a structure of an air conditioner according to Embodiment 7 of the present invention.

FIG. 9 shows a structure of the air conditioner according to Embodiment 7. In FIG. 9, numeral reference 23 designates an expansion valve bypass pipe between which an on-off valve 22 (fifth on-off valve) for bypassing an electronic expansion valve 4 is intermediate, which pipe connects an outlet of a condenser 2 to an inlet of an evaporator 7. The same references as those in FIG. 1 designate portions the same as or similar to those in FIG. 1, and an arrow in FIG. 9 designates a direction of refrigerant flow.

As in Embodiment 1, the air conditioner according to Embodiment 7 includes an outdoor unit 5, an indoor unit 9, a liquid pipe 6 for connecting these units, and a gas pipe 10 for connecting the units.

The outdoor unit 5 includes a compressor 1 for compressing a refrigerant gas, a condenser 2 for cooling and liquefying this refrigerant gas, an outdoor fan 3 for forcibly supplying an outdoor air to an outer surface of the condenser 2, an electronic expansion valve 4 for depressurizing a high-temperature high-pressure refrigerant liquid out of the condenser 2 and rendering it wet-vapor of a two-phase state, an accumulator 14 for preventing a liquid from returning to the compressor 1 by a transient state, overcharging of a refrigerant or the like, an on-off valve 13 for bypassing the compressor 1 and the accumulator 14, a compressor bypass pipe 12 between which a check valve 11 is intermediate, a check valve 16 for preventing a refrigerant from flowing into the compressor 1 in natural circulation operation, and an expansion valve bypass pipe 23 between which an on-off valve 22 is intermediate for bypassing the electronic expansion valve 4.

The indoor unit 9 includes an evaporator 7 for evaporating the wet-vapor flowing from a liquid pipe 6 by an air conditioning load and an indoor fan 8.

In the air conditioner according to Embodiment 7, when forced circulation operation is performed, the on-off valve 22 is closed, the on-off valve 13 is opened, and an opening degree of the electronic expansion valve 4 is set to be an appropriate opening degree for depressurizing a refrigerant liquid flowing from the condenser 2 and rendering it wet-vapor of a two-phase state, for example about 15% of the full opening degree. Thereafter, the compressor 1 is run. At this time, the check valve 11 is closed by a pressure difference between a discharge pressure and a suction pressure of the compressor 1, whereby a cycle of the forced circulation operation is formed.

Further, when the natural circulation operation is performed, the on-off valve 13 is closed, the on-off valve 22 is opened, and an opening degree of the electronic expansion valve 4 is full, whereby the check valve 11 is released by a flow of refrigerant, wherein a circuit for the natural circulation operation is formed. At the time of natural circulation operation, a refrigerant flowing out of the condenser 2 branches on the side of electronic expansion 4 and the side of expansion valve bypass pipe 23. Ordinarily, when a pressure loss of a refrigerant flowing through a fully opened electronic expansion valve 4 and a pressure loss of a refrigerant flowing through the expansion valve bypass pipe 23 for bypassing the electronic expansion valve 4 through the on-off valve 22 are compared, the pressure loss in the expansion valve bypass pipe 23 tends to be small. Accordingly, most portion of a refrigerant flows through the expansion valve bypass pipe 23 in the natural circulation operation.

In the air conditioner according to Embodiment 7, it is possible to drastically reduce a pressure loss of a refrigerant in a liquid pipe by sending a refrigerant to the expansion valve bypass pipe 23 at the time of natural circulation operation and prevent deterioration of cooling capability in the natural circulation operation caused by an increment of pressure loss in the refrigerant circuit in a case such that the liquid pipe 6 or the gas pipe 10 is long.

Additionally, it is constructed such that the electronic expansion valve 4 can be bypassed by the bypass circuit 23 between which the on-off valve 22 is intermediate, it is possible to perform the natural circulation operation by releasing the on-off valve 22 even in a case that the electronic expansion valve 4 is fixed to a certain opening degree by failure at a time of forced circulation operation, whereby reliability of the system can be improved.

As described in the above, when the electronic expansion valve 4 is fully opened in the natural circulation operation, most of a refrigerant flows through the expansion valve bypass pipe 23. Therefore, under a condition that an opening degree of the electronic expansion valve 4 is in an opening degree for the forced circulation operation, it may be switched over to the natural circulation operation. Even in such a case, cooling capability is not substantially changed.

EMBODIMENT 8

Figure 10:
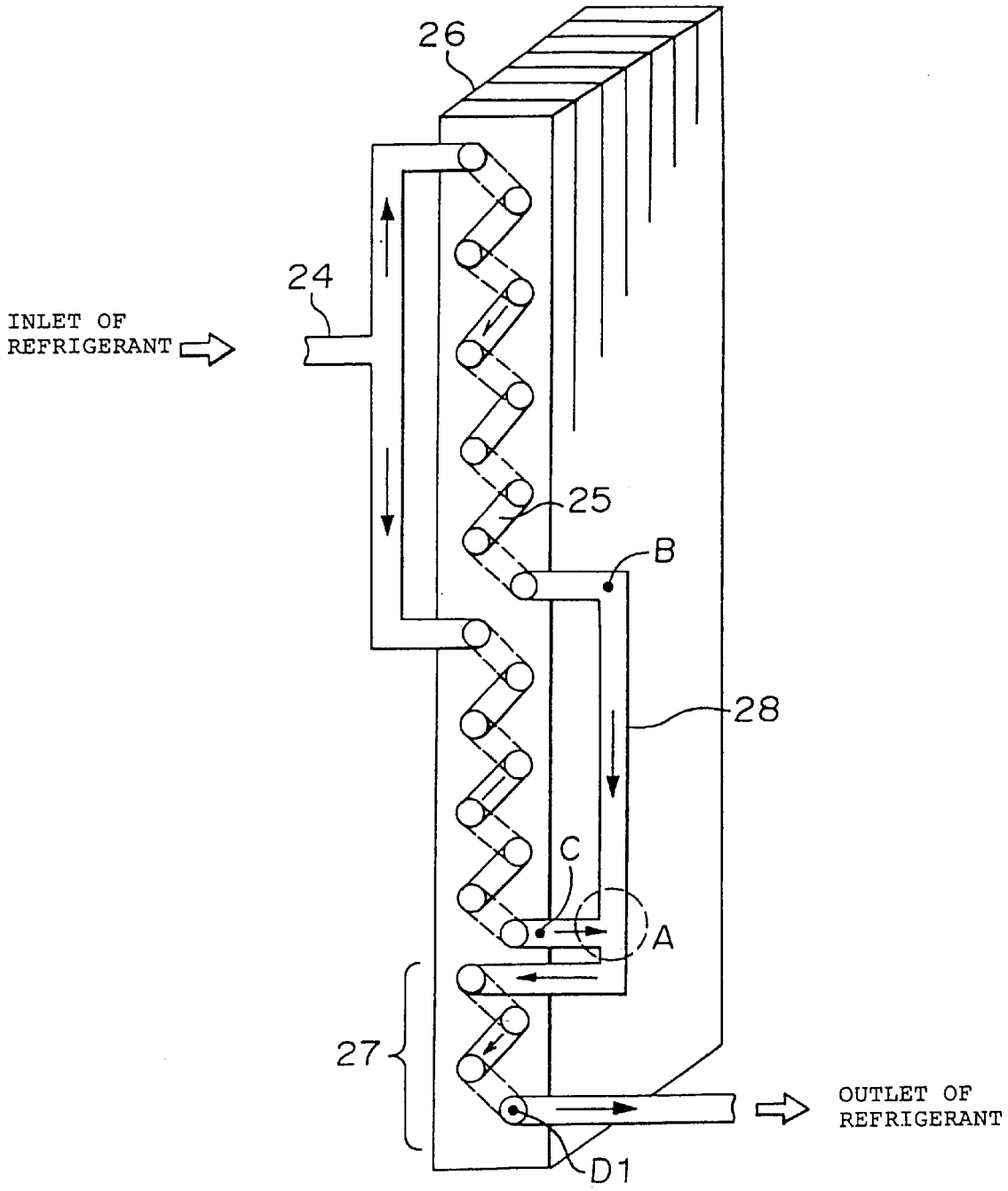
FIG. 10 schematically shows a structure of a condenser according to Embodiment 8 of the present invention.

Hereinbelow, a condenser used for an air conditioner, for example a cooling device, according to Embodiment 8 of the present invention will be described. FIG. 10 shows a structure of the condenser of the air conditioner according to Embodiment 8. In FIG. 10, numerical reference 24 designates an inlet tube; numerical reference 25 designates a heat transfer tube; numerical reference 26 designates a fin perpendicularly crossing the heat transfer tube; numerical reference 27 designates a subcooling portion provided in a lower portion in the condenser; and numerical reference 28 designates an outlet tube.

A plurality of fins 26 are provided to be substantially parallel to each other, and a heat transfer tube 25 penetrates through the fins 26 and is connected to other heat transfer tube positioning just below the tube 25 at an end fin 26, whereby a refrigerant path is formed. Further, the heat transfer tubes 25 in the condenser are vertically divided into a plurality of refrigerant paths, for example two refrigerant paths.

The refrigerant gas flowing into the condenser branches into two paths of an upper path and a lower path at the inlet tube 24. Thereafter, the refrigerant gas emits a heat to an outer air while it flows into the heat transfer tubes 25 on the downstream side in the respective paths. Thereafter, the gas is joined at a portion A of the outlet tube 28 so as to flow into a single path. Further, the gas flows into the subcooling portion 27. A flow rate of a refrigerant after joining at the portion A is increased, the refrigerant is subcooled to some extent and flows into a liquid pipe from an outlet (D1) of refrigerant in the condenser.

In Embodiment 8, the heat transfer pipe 25 in the condenser is constructed such that a refrigerant downward flows. For example, in a case that a condenser is constituted such that a refrigerant upward flows, there may be a phenomenon such that the condensed refrigerant accumulates in the heat transfer tube 25 or flows reversely in the heat transfer tube 25 and thereby a refrigerant liquid is not securely supplied to the outlet for refrigerant in the condenser to achieve natural circulation operation. The condenser according to Embodiment 8 is constituted such that refrigerant in the refrigerant paths respectively flow in the downward direction, particularly in the natural circulation operation, it is possible to prevent the phenomenon of accumulating and back-flowing of a condensed refrigerant liquid in a middle of heat transfer tube 25 and to obtain proper cooling capability in a stable manner.

In addition, Embodiment 8 is not limited to the structure in which a refrigerant path branches into two paths in the condenser. It is possible to obtain stable cooling capability particularly in the natural circulation operation by preventing the phenomenon of accumulating or back-flowing of condensed refrigerant liquid in a middle of heat transfer tube as long as a refrigerant flow is downward even in a structure that the refrigerant path is single or the refrigerant path branches into three or more paths.

Further, in Embodiment 8, as for the number of the heat transfer tubes 25 composing the divided two refrigerant paths, the number of the heat transfer tubes 25 in the upper refrigerant path is larger than that in the lower refrigerant path so that the upper refrigerant path is longer than the lower refrigerant path. Because a quantity of refrigerant flow from the inlet tube 24 is distributed so that pressure losses in the upper refrigerant path and the lower refrigerant path becomes equal, a quantity of the upper refrigerant flow is smaller than that of the lower refrigerant flow.

Generally, in a condenser constructed to be arranged in the vertical direction and have two branching paths as shown in FIG. 10, when the upper path and the lower path have the same length, a liquid column is formed in the outlet tube 28; a pressure difference is caused by an altitudinal difference; and a pressure at the outlet of the lower refrigerant path designates by reference C becomes higher than a pressure at the outlet of the upper refrigerant path designated by reference B. Accordingly, as a path of refrigerant is positioned low, a refrigerant is hard to flow, whereby distribution of refrigerant flow flowing from the inlet tube 24 becomes uneven with respect to an upper portion and a lower portion of the refrigerant.

Meanwhile, the condenser according to Embodiment 8, it is constructed that the number of the heat transfer tubes 25 through which a refrigerant paths in an upper refrigerant path becomes larger than that in lower refrigerant paths. Accordingly, a pressure loss of a refrigerant in the upper refrigerant path is larger than that in the lower refrigerant paths, and therefore a quantity of refrigerant flow through the upper refrigerant path becomes smaller than that through the lower refrigerant paths. Thus in a case that the condenser is vertically arranged, there is an effect that the distribution of refrigerant flow is made uniform by absorbing a pressure difference caused by an altitudinal difference in adjusting the number of the heat transfer tubes 25.

Further, in a case that a vertically rising pipe is provided for a connection pipe between an outlet of refrigerant in a condenser and a liquid pipe composing a refrigerating circuit, a condensed refrigerant liquid may not ascend in the rising pipe. In such a case, the natural circulation operation is not realized. Such a phenomenon is often observed in a case that a sufficient degree of subcooling is not obtainable and bubbles are contained in a condensed refrigerant liquid or the like. However, there was a problem in the natural circulation operation that a rising pipe is sometimes required to use for the convenience of piping. The condenser according to Embodiment 8 has the subcooling portion 27 in its lower portion to securely serve a degree of subcooling. Therefore, it is possible to prevent a refrigerant from accumulating even in a case that a certain rising pipe exists in the connection pipe between the outlet of refrigerant in the condenser and the liquid pipe, it is possible to prevent a refrigerant from accumulating and an air conditioner having appropriate cooling capability is obtainable in a stable manner.

Although the case that the refrigerant path branches to the two paths was described in Embodiment 8, the description can be applied to a case that the refrigerant path vertically branches into three paths. As long as it is constructed such that a pressure loss in an upper refrigerant path is larger than a pressure loss in a lower refrigerant path, it is possible to perform the natural circulation operation by which appropriate cooling capability is obtainable in a stable manner.

In order to increase a pressure loss in the upper refrigerant path with respect to a pressure loss in the lower refrigerant path, not only the structure that the number of upper heat transfer tubes is increased as described in the above but also a structure that an inner diameter of upper heat transfer tubes 25 is made smaller than that of lower heat transfer tubes to facilitate a flowing of refrigerant through the lower refrigerant path, whereby a similar effect thereto is obtainable.

EMBODIMENT 9

Hereinbelow, an evaporator used in an air conditioner, for example a cooling device, according to Embodiment 9 of the present invention will be described.

Figure 11:
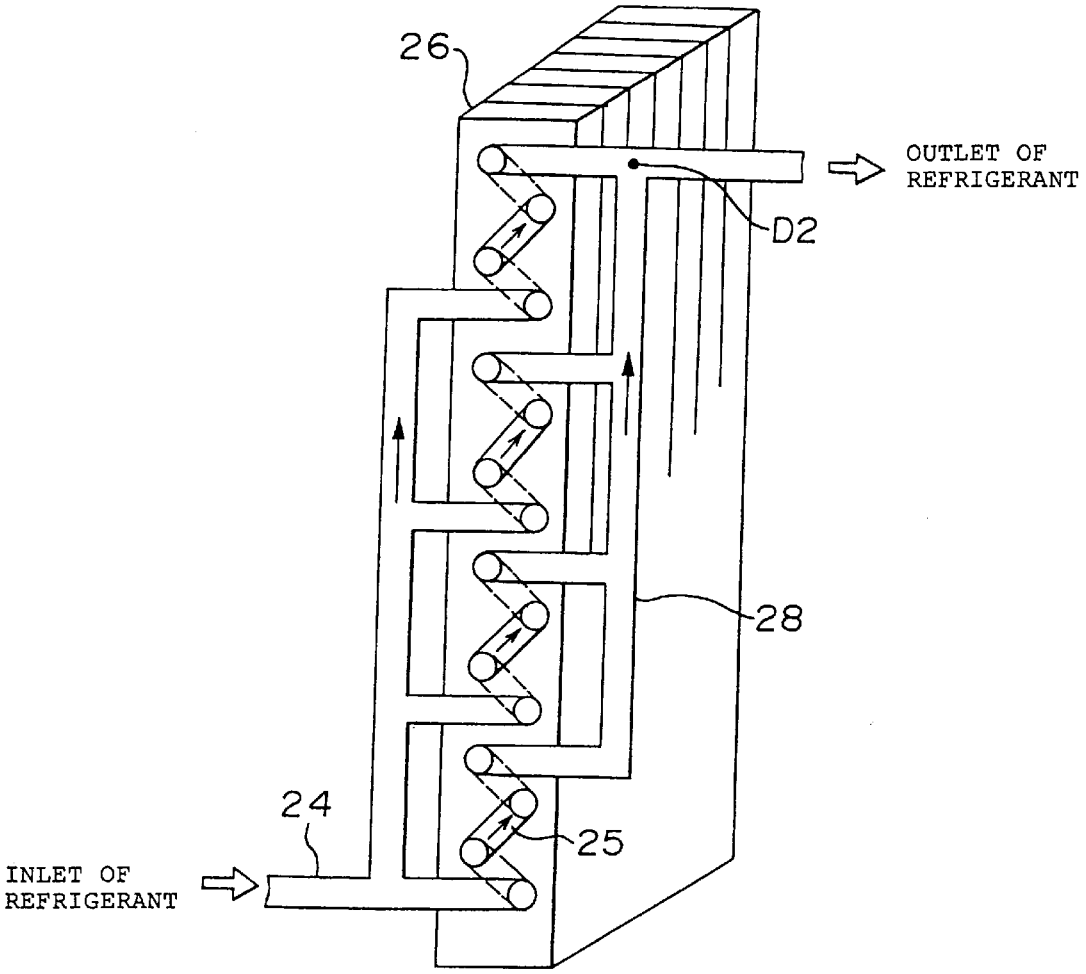
FIG. 11 schematically shows a structure of an evaporator according to Embodiment 9 of the present invention.

FIG. 11 shows a structure of the evaporator concerning the air conditioner according to Embodiment 9. In FIG. 11, numerical reference designates an inlet tube; numerical reference 25 designates heat transfer tubes; numerical reference 26 designates fins perpendicularly crossing the heat transfer tubes 25; and numerical reference 28 designates an outlet tube.

As in the structure of the condenser according to Embodiment 8, the plurality of fins 26 are provided to be substantially parallel to each other; the heat transfer tubes 25 respectively penetrate the fins 26; and a heat transfer tube 25 is connected to other heat transfer tube positioning just above the tube 25 in an end fin 26, whereby a refrigerant path is formed.

A refrigerant flowing into the evaporator branches at the inlet tube 24 vertically to four paths and evaporates in receipt of an indoor air conditioning load while it flows from a lower heat transfer tube 25 to an upper heat transfer tube 25. Thereafter, the refrigerant is joined and flows into a gas pipe from an outlet (D2) of the refrigerant.

In Embodiment 9, the evaporator is constructed such that the number of heat transfer tubes 25 through which a refrigerant paths in each branch path is equal and the length of each branch refrigerant path is substantially equal.

Generally, in a case that heat transfer tubes 25 in an evaporator 7 is downward routed, a case that an evaporated refrigerant gas accumulates or ascends in a heat transfer tube 25 and a back flow occurs in a heat transfer tube 25 to avoid the natural circulation operation may occur. The evaporator according to Embodiment 9 is constructed such that a direction of refrigerant flow is downward. Therefore, it is possible to prevent a phenomenon of accumulating or reversely flowing of an evaporated refrigerant gas in a heat transfer tube 25 and to perform the natural circulation operation by which appropriate cooling capability is obtainable in a stable manner.

Although, in Embodiment 9, the refrigerant path branches into the four paths in the evaporator, the number of branches is not limited to four and it may be branches into three paths or less, or five paths or more, as long as these refrigerant paths are respectively constituted to flow upward, wherein a similar effect to those described in the above can be obtained.

EMBODIMENT 10

Figure 12:
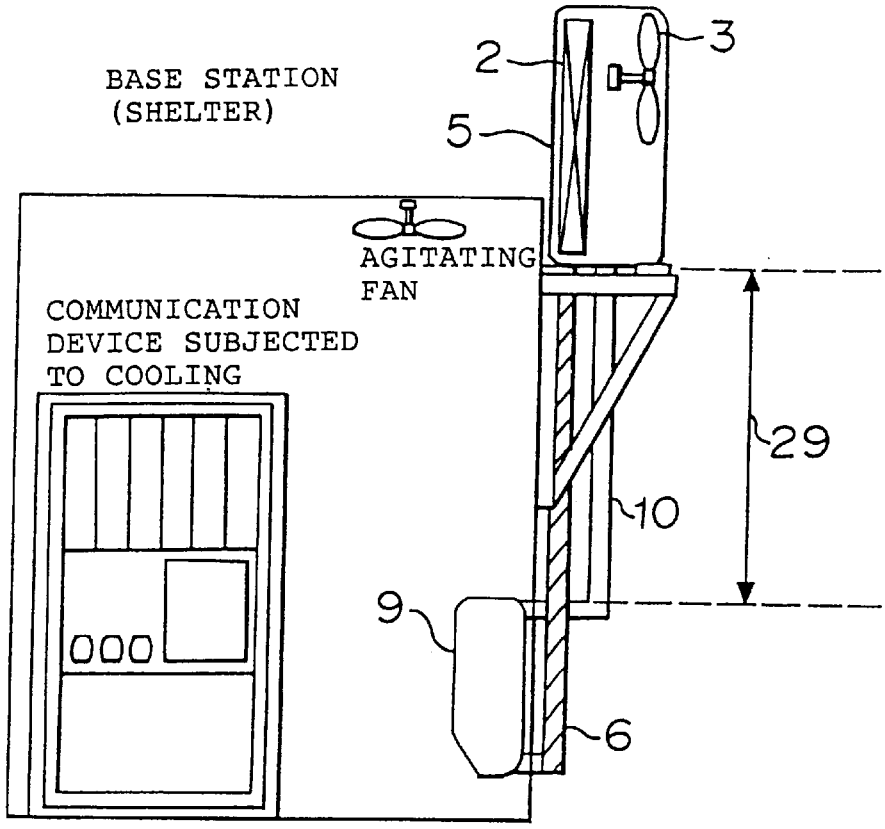
FIG. 12 schematically shows arrangement of an air conditioner provided in a base station according to Embodiment 10 of the present invention.

Hereinbelow, an air conditioner, for example a cooling device, according to Embodiment 10 of the present invention will be described. FIG. 12 shows a structure of a base station (shelter) accommodating a computer center or relay electronic machines for mobile communication in which the air-conditioner according to Embodiment 10 is shown.

An outdoor unit 5 of the air conditioner is located on a trestle fixed to an outer wall surface of the base station, and an indoor unit 9 is fixed to a wall surface of the inside of base station. The outdoor unit 5 and the indoor unit 9 are connected by a liquid pipe 6 and a gas pipe 10. The indoor unit 9 is positioned at a possible lowest height from the floor without eliminating a working space for a filter change and so on. The same references as those in FIG. 1 designate portions the same as or similar to those in FIG. 1.

In Embodiment 10, it is constructed that a heat transfer area of the evaporator in the indoor unit 9 is larger than that of the condenser in the outdoor unit 5. In here, the heat transfer area is obtained by adding a surface area of fins composing the condenser or the evaporator to a surface area of the outside of all heat transfer tubes composing a refrigerant path. Specifically, it is possible to change the heat transfer area by varying an interval between the fins, the number of rows or columns of a heat exchanger having these fins or varying the outer diameter of heat transfer tubes, respectively in the evaporator and the condenser.

A connecting portion between the outdoor unit 5 and the liquid pipe 6 is positioned at a lower portion of the outdoor unit 5 and an altitudinal difference 29 between the outdoor unit 5 and the indoor unit 9 is within a range of 0.5 m or more and 2.0 m or less. In here, the altitudinal difference 29 is a difference between the height of an outlet of refrigerant in the condenser and the height of an outlet of refrigerant in the evaporator. Specifically, it is a distance between the height of the outlet D1 of refrigerant after the branching refrigerants join in the condenser shown in FIG. 10 and the height of the outlet D2 of refrigerant after the branching refrigerants join in the evaporator shown in FIG. 11.

Figure 16:
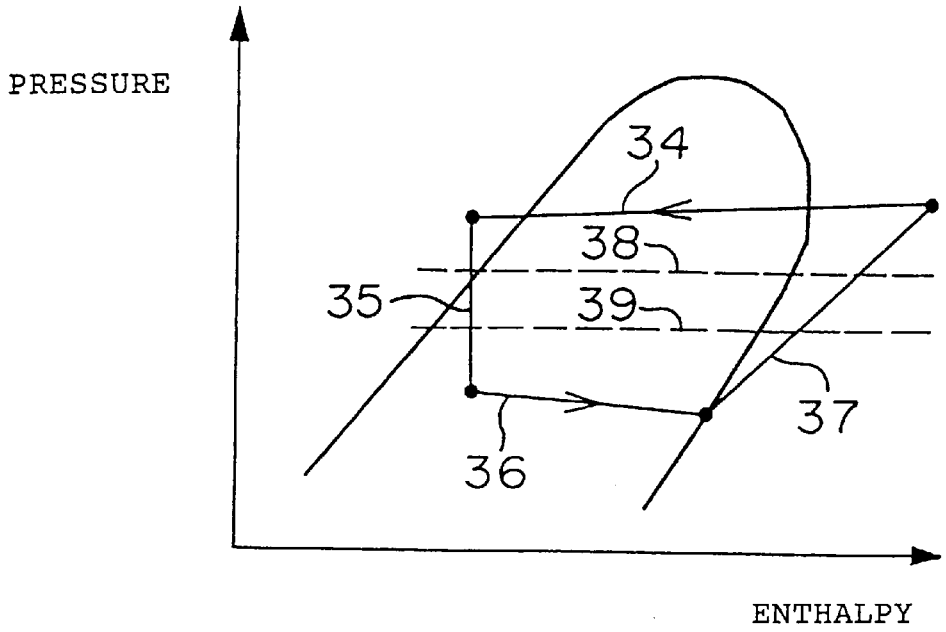
FIG. 16 is a characteristic diagram for showing a relationship between a pressure and an enthalpy under forced circulation operation.
Figure 17:
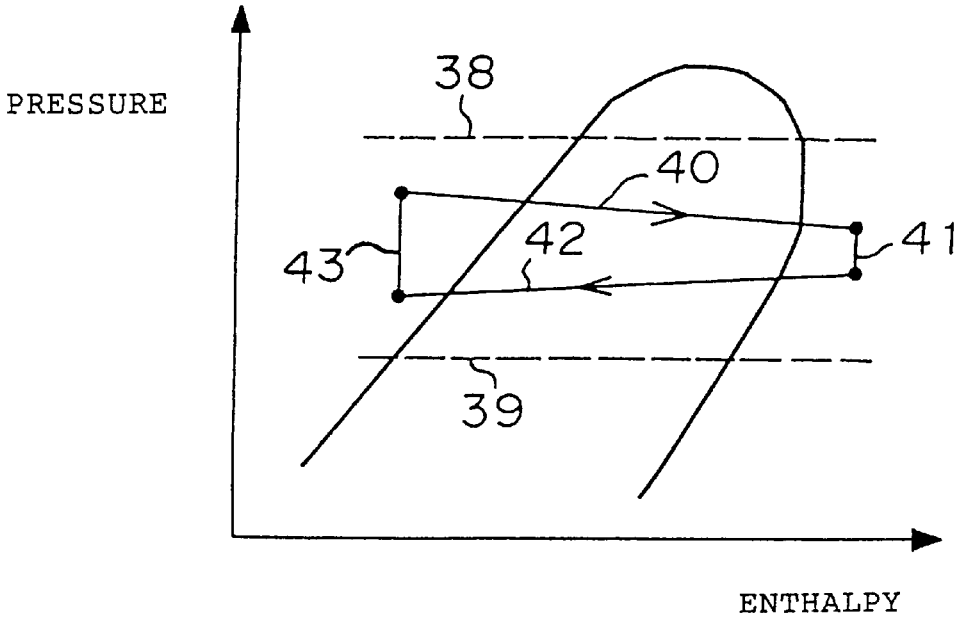
FIG. 17 is a characteristic diagram for showing a relationship between a pressure and an enthalpy under natural circulation operation.

Meanwhile, generally in a case of the forced circulation operation, a difference of enthalpy in a condenser becomes larger than a difference of enthalpy in an evaporator by a quantity of inputting to the compressor as shown in FIG. 16. Accordingly, a heat transfer area of the condenser is generally set to be larger than that of the evaporator in order to restrict a rise of condensing pressure. Further, an air volume to the condenser is set to be larger than that to the evaporator in accordance with an expansion of heat transfer area. By construct, in a case of the natural circulation operation, because a difference of enthalpy between the condenser and the evaporator and the pressure are substantially equal, it is not necessary to set the heat transfer area of condenser larger than that of the evaporator like the forced circulation operation. In other words, in the natural circulation operation, it is possible to constitute a refrigerant circuit suitable for the natural circulation operation by decreasing a heat transfer area of the condenser because a difference of enthalpy in the condenser is small and by increasing a heat transfer area of the evaporator because a difference of enthalpy in the evaporator is large, with respect to the forced circulation operation.

The air-conditioner according to Embodiment 9 is constructed such that the heat transfer area of evaporator is larger than the heat transfer area of condenser, whereby it is possible to provide a refrigerant circuit suitable for the natural circulation operation.

Figure 13:
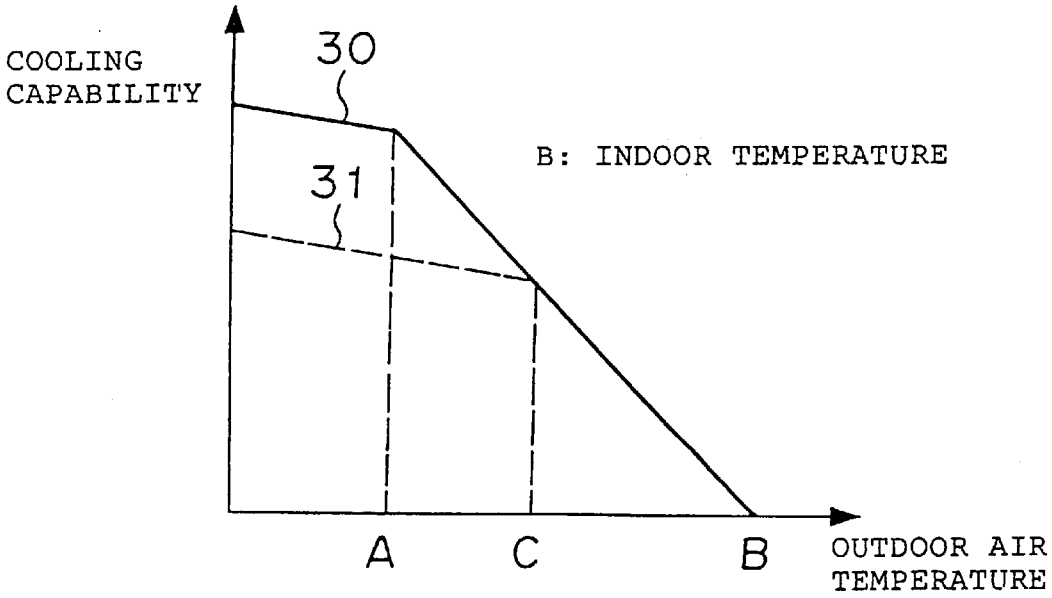
FIG. 13 is a characteristic diagram for showing a change of cooling capability of an air conditioner with respect to an outdoor air temperature in accordance with Embodiment 10 of the present invention.

FIG. 13 shows a characteristic of cooling capability in the natural circulation operation with respect to an outdoor air temperature when an indoor temperature is B. A line 30 designates a case that an altitudinal difference between the outdoor unit 5 and the indoor unit 9 is large, for example about 2 m. A line 31 designates a case that the attitudinal difference is small, for example about 0.5 m, when the altitudinal difference is large as designated by the line 30. Since a quantity of refrigerant flow increases as the outdoor air temperature decreases until it arrives at a point A, cooling capability is enhanced. However, after the outdoor air temperature falls less than the point A, a rate of increase in the cooling capability is abruptly diminished by a restriction on the altitudinal difference, which is a driving force for circulating a refrigerant. By contrary, when the altitudinal difference is small as designated by the lime 31, since a point from which the rate of increase in the cooling capability is abruptly diminished changes up to a point C, a range among which effective cooling capability is obtainable becomes narrow.

Figure 14:
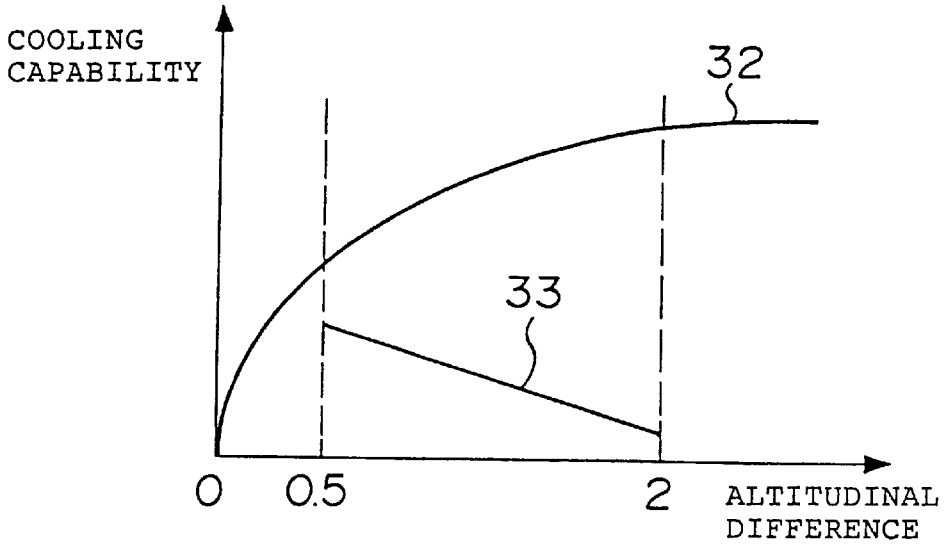
FIG. 14 is a characteristic diagram for showing a change of cooling capability with respect to an altitudinal difference between an indoor unit and an outdoor unit of an air conditioner in accordance with Embodiment 10 of the present invention.
Figure 15:
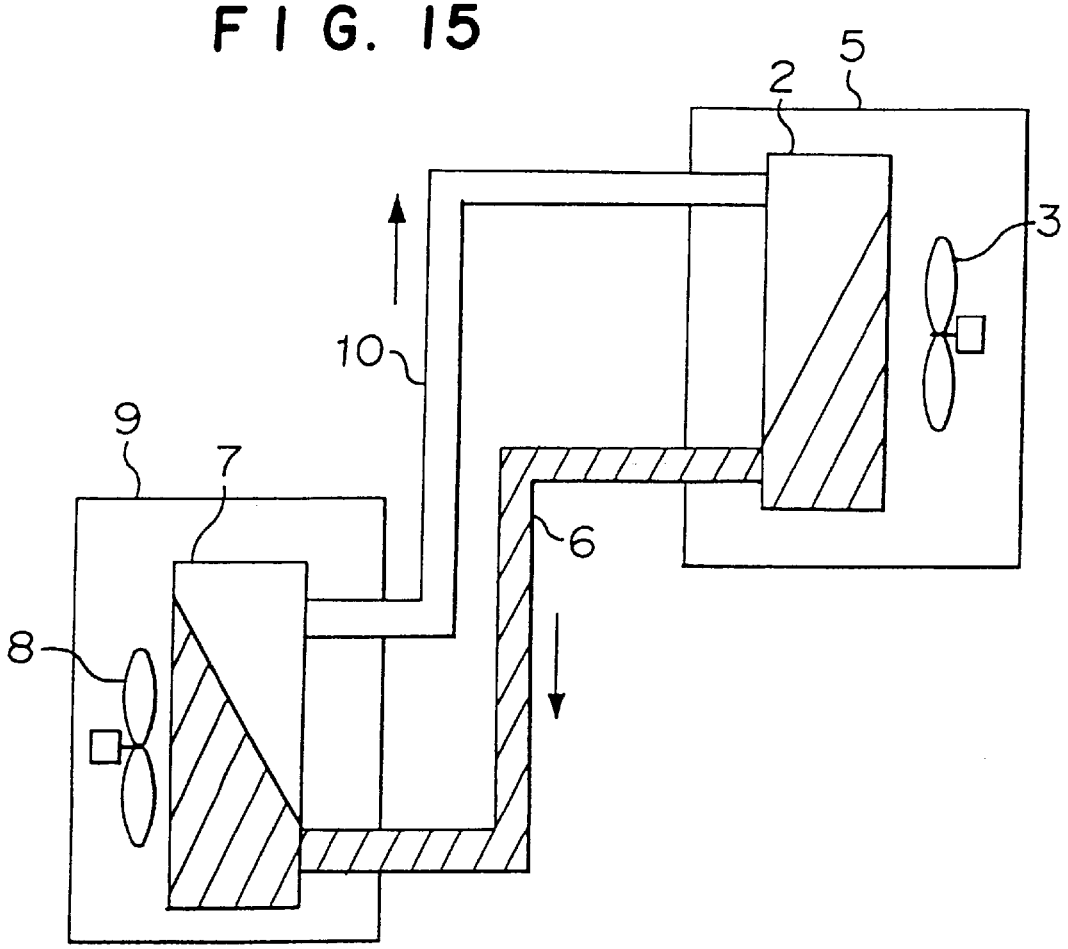
FIG. 15 schematically shows a structure of an air conditioner for explaining a principle of cooling operation by a natural circulation.

FIG. 14 shows a characteristic of relation between the altitudinal difference between the outdoor unit 5 and the indoor unit 9 and cooling capability. A line 32 designates a capability diagram in a case that a difference between an outdoor temperature and an indoor temperature is large, for example, $\Delta T$ is about 20° C. A line 33 designates a capability diagram in a case that the temperature difference is small, for example $\Delta T$ is about 10° C. In addition, this capability diagram is about a case that R22 having a high pressure loss is used as a refrigerant.

In a case that the difference between an outdoor temperature and an indoor temperature is large, because a quantity of flow through a refrigerant circuit is increased in accordance with an increment of altitudinal difference, cooling capability is increased along with the increment of altitudinal difference. In this, when the altitudinal difference is smaller than 0.5 m, a range among which effective cooling capability is obtainable with respect to a load becomes narrow as designated by the line 32.

Incidentally, if the altitudinal difference is excessively large, the length of the liquid pipe 6 and/or the length of the gas pipe 10 becomes long along with an increment of the altitudinal difference, whereby a pressure loss in a refrigerant circuit increases; cooling capability is deteriorated as shown in the line 33 of FIG. 14; and the natural circulation operation is not realized, when the temperature difference between an outdoor temperature and an indoor tempter is small. Meanwhile, when the altitudinal difference is larger than 2 m, a refrigerating machine oil discharged from the compressor 1 along with a refrigerant gas in the forced circulation operation can not ascends through the gas pipe 6 as an uprising pipe, whereby there is a possibility that a phenomenon such that the compressor 1 is seized by mallubrication or capability of the natural circulation operation is deteriorated. Especially, when the altitudinal difference is larger than 2 m, the total height of base station (shelter) becomes high. Further, components of the base station are ordinarily assembled in a factory so that an adjustment becomes easy and is delivered by a track or the like. However, when the length of component is larger than 2 m, there are problems such that the delivery becomes difficult; an installation workability is deteriorated; and a location of installing it is limited. Because of these reasons, it is desirable to render the altitudinal difference 29 between the condenser and the evaporator 2 m or less.

In the air conditioner according to Embodiment 10, the altitudinal difference between the outdoor unit 5 and the indoor unit 9 is set to be a range of between 0.5 and 2 m. Therefore, it is possible to obtain the air-conditioner by which appropriate cooling capability is obtainable in a stable manner regardless of a difference between an outdoor temperature and an indoor temperature without causing the above-mentioned problems. By the way, the cooling capability obtainable by the range of thus set altitudinal difference 29 somewhat varies depending on a type of refrigerant, a pressure loss in a refrigerant pipe and so on. In other words, when a refrigerant having a small pressure loss, for example R410A, is used, since the capability diagram shown in FIG. 14 has a tendency to enhancing the cooling capability, sufficient cooling capability is obtainable by setting an altitudinal difference within the range described in the above.

In addition, in the air conditioner according to Embodiment 10, a refrigerant pipe is further extended from the outlet (D1) of a refrigerant in the condenser 2 and a connecting portion with the liquid pipe 6 composing the refrigerant circuit is arranged below a bottom portion of the outdoor unit 5 for accommodating the condenser 2. Accordingly, there is an effect that work for connecting the liquid pipe 6 to the outdoor unit 5 located in a high position becomes easy.

Additionally, a similar effect thereto is obtainable with respect to the gas pipe 10. By arranging a connecting portion between the inlet of refrigerant in the condenser 2 and the gas pipe 10 forming the refrigerating circuit is arranged below a bottom portion of the outdoor unit 5 for accommodating the condenser 2, it is possible to facilitate work for connecting the gas pipe to the outdoor unit 5 located at a high position.

The first advantage of the present invention is that two functions of reducing pressure necessary for forced circulation operation and of bypassing an expansion valve necessary for natural circulation operation is realized by a single electronic expansion valve and thereby an air conditioner having a simple structure is obtainable because the air conditioner has a refrigerating circuit obtained by sequentially connecting a compressor, a condenser, an electronic expansion valve of which opening degree is controllable, and an evaporator by pipes, and a compressor bypass pipe for connecting an outlet of the evaporator and an inlet of the condenser through a first on-off valve; the forced circulation operation of running the compressor by closing the first on-off valve and the natural circulation operation of stopping the compressor by opening the first on-off valve are selectively switched over; and an opening degree of the electronic expansion valve is controlled respectively in the forced circulation operation and the natural circulation operation.

The second advantage of the air conditioner according to the present invention is that the first on-off valve is unnecessary to open or close in response to the forced circulation operation or the natural circulation operation and a refrigerant circuit can easily be switched over because a check valve is used for the first on-off valve to open a flow of refrigerant from the outlet of evaporator to the inlet of condenser and to close the back flow.

The third advantage of the air conditioner according to the present invention is that an excessive refrigerant generated during the forced circulation operation can be absorbed because an accumulator is provided in a pipe between an inlet of compressor bypass pipe and an inlet of compressor.

The fourth advantage of the air conditioner according to the present invention is that an excessive refrigerant generated during the forced circulation operation can be absorbed and simultaneously it is possible to prevent a refrigerant from flowing into the accumulator; and therefore, the air conditioner by which a quantity of refrigerant necessary for the natural circulation operation is always secured is obtainable by providing a second on-off valve between an inlet of compressor bypass pipe and an inlet of accumulator.

The fifth advantage of the air conditioner according to the present invention is that an on-off valve for preventing a refrigerant from flowing into an accumulator is unnecessary; a refrigeration circuit can be constituted at a low cost; a refrigerant recovery operation becomes unnecessary; and an annual consumption power can be reduced by providing a heating means for heating a refrigerant in the accumulator.

The sixth advantage of the air conditioner according to the present invention is that it is possible to prevent a refrigerant from flowing into the compressor and condensing therein at the time of natural circulation operation; a quantity of a refrigerant necessary for the natural circulation operation can be secured; and reliability of the compressor can be improved by providing a third on-off valve in a pipe between the outlet of compressor and the outlet of compressor bypass pipe.

The seventh advantage of the air conditioner according to the present invention is that it is unnecessary to open or close in response to the forced circulation operation or the natural circulation operation; condensation of a refrigerant in the compressor can securely be avoided by using a check valve of opening a refrigerant flow from the outlet of compressor to the outlet of compressor bypass pipe and of closing the back flow is used for the third on-off valve.

The eighth advantage of the air conditioner according to the present invention is that a refrigerant stored in the accumulator can be recovered to the natural circulation circuit without reducing a suction pressure of the compressor by connecting a high-pressure pipe extending from the outlet of compressor to the inlet of condenser and a low-pressure pipe extending from the outlet of electronic expansion valve to the inlet of compressor are connected by a bypass pipe in which a fourth on-off valve is interposed.

The ninth advantage of the air conditioner according to the present invention is that it is possible to prevent an excessive refrigerant from accumulating in the condenser at a time of forced circulation operation and also to prevent a heat transfer area effective for condensation from reducing by providing a liquid receiver for storing a refrigerant liquid in a pipe between the outlet of condenser and the inlet of electronic expansion valve, and a refrigerant recovery operation becomes unnecessary because the excessive refrigerant is accumulated in the liquid receiver.

The tenth advantage of the air conditioner according to the present invention is that it is possible to restrict deterioration of cooling capability caused by a refrigerating machine oil circulating in a refrigerant circuit during the natural circulation operation by providing an oil separator for separating the refrigerating machine oil from a refrigerant in a pipe between the outlet of compressor and the inlet of condenser.

The eleventh advantage of the air conditioner according to the present invention is that it is possible to prevent cooling capability of natural circulation operation caused in a case that a liquid pipe and/or a gas pipe is long or a case that an expansion valve is broken from deteriorating; and reliability of the system can be improved by connecting the outlet of condenser and the inlet of evaporator by a expansion valve bypass pipe in which a fifth on-off valve is interposed.

The twelfth advantage of the air conditioner according to the present invention is that it is possible to prevent a refrigerant gas from flowing into a compressor at a time of natural circulation operation and condensing therein; a quantity of refrigerant necessary for the natural circulation operation can be secured; and reliability of the compressor can be improved because the air conditioner includes a refrigerating circuit obtained by successively connecting the compressor, a condenser, an expansion valve, and an evaporator by pipes, a compressor bypass pipe for connecting an outlet of the evaporator to an inlet of the condenser through a first on-off valve, and a third on-off valve provided in a pipe between an outlet of the compressor and an outlet of the compressor bypass pipe; and forced circulation operation of running the compressor by closing the first on-off valve and opening the third on-off valve and the natural circulation operation of stopping the condenser by opening the first on-off valve and closing the third on-off valve are selectively switched over.

The thirteenth advantage of the air conditioner according to the present invention is that it is not necessary to open or close the third on-off valve in response to forced circulation operation or natural circulation operation; and it is possible to easily prevent a refrigerant from flowing into the compressor by using a check valve for opening a refrigerant flow from the outlet of compressor to the outlet of compressor bypass pipe and closing the back flow as the third valve.

The fourteenth aspect of the air conditioner according to the present invention it that it is possible to prevent a phenomenon that natural circulation operation is not realized caused by detect or a back flow of a refrigerant liquid condensed in a heat transfer pipe by constituting the condenser so that a refrigerant flowing thereinto flows downward.

The fifteenth advantage of the air conditioner according to the present invention is that it is possible to prevent a refrigerant liquid from accumulating even in a case that an uprising pipe exists in a connection pipe between an outlet of the condenser and a liquid pipe; and a rate of subcooling can be securely gained because refrigerant tubes in the condenser are vertically divided into a plurality of refrigerant paths so that portions of branching refrigerant respectively flow downward through the refrigerant paths subsequently joined at the outlet of condenser; and a subcooling portion is provided in a lower portion in the condenser.

The sixteenth advantage of the air conditioner according to the present invention is that it is possible to unify a distribution of flow quantity to a plurality of the refrigerant paths because refrigerant tubes in the condenser are vertically divided into the plurality of refrigerant paths so that portions of branching refrigerant respectively flow downward through the refrigerant paths succeedingly joining at the outlet of condenser; and the length of upper refrigerant path is longer than that of lower refrigerant path.

The seventeenth aspect of the air conditioner according to the present invention is that it is possible to restrict a phenomenon that an evaporated refrigerant gas accumulated or reversely flowed in a heat transfer tube by constituting the evaporator so that a refrigerant flowing into the evaporator upward flows through the evaporator.

The eighteenth advantage of the air conditioner according to the present invention is that a pressure loss in a refrigerant circuit can be reduced; and it is possible to restrict deterioration of cooling capability in natural circulation operation by rendering the diameter of a pipe connecting the outlet of evaporator to the inlet of condenser larger than the diameter of a pipe connecting the outlet of condenser to the inlet of evaporator.

The nineteenth advantage of the air conditioner according to the present invention is that a refrigerant circuit suitable for natural circulation operation can be obtained by rendering a heat transfer area of the evaporator larger than that of the condenser.

The twentieth advantage of the air conditioner according to the present invention is that appropriate cooling capability can be obtained regardless of a value of difference between an outdoor air temperature and an indoor air temperature because the height of an outlet of refrigerant tubes in the condenser is higher than the height of an outlet of refrigerant tubes in the evaporator by 0.5 m or more through 2 m or less.

The twenty-first advantage of the air conditioner according to the present invention it that piping work with respect to the outdoor unit located at a high position can be easy by arranging a connecting portion between the outlet of refrigerant tubes in the condenser and a liquid pipe composing a refrigeration circuit to be lower than a bottom portion of a package of accommodating the condenser.

Obviously, numerous modifications and variations of the present invention are possible in light of the above teachings. It is therefore to be understood that within the scope of the appended Claims, the invention may be practiced otherwise than as specifically described herein.

What is claimed is:

1. An air conditioner, comprising:

a refrigeration circuit formed by sequentially connecting a compressor, a condenser, an electronic expansion valve capable of controlling an opening degree thereof, and an evaporator by pipes;

a compressor bypass pipe connecting an outlet of said evaporator and an inlet of said condenser interposing a first on-off valve;

a controller which switches the air conditioner to:

a forced circulation operation in which said first on-off-valve is closed, said expansion valve is opened to a first degree to allow refrigerant to pass therethrough, and said compressor is in a running state, or a natural circulation operation in which said first on-off valve is opened, said expansion valve is opened to a second degree, different from said first degree, to allow refrigerant to pass therethrough, and said compressor is in a stopping state.

2. An air conditioner, comprising:

a refrigeration circuit formed by sequentially connecting a compressor, a condenser, an electronic expansion valve capable of controlling an opening degree thereof, and an evaporator by pipes;

a compressor bypass pipe connecting an outlet of said evaporator and an inlet of said condenser interposing a first on-off valve;

the air conditioner is switched to a forced circulation operation in which said first on-off valve is closed and said compressor is in a running state or to a natural circulation operation in which said first on-off valve is opened and said compressor is in a stopping state, and the opening degree of said electronic expansion valve is controlled respectively in accordance with said forced circulation operation and said natural circulation operation;

wherein said first on-off valve is a check valve for allowing a flow of refrigerant from said outlet of said evaporator to said inlet of said condenser and prohibiting a back flow flowing.

3. An air conditioner according to claim 1, further comprising:

an accumulator provided in a pipe between an inlet of said compressor bypass pipe and an inlet of said compressor; and a second on-off valve between said inlet of said compressor bypass pipe and an inlet of said accumulator.

4. An air conditioner according to claim 3, further comprising:

a heating means for heating a refrigerant in said accumulator.

5. An air conditioner according to claim 1, further comprising:

another on-off valve provided in a pipe between an outlet of said compressor and an outlet of said compressor bypass pipe.

6. An air conditioner according to claim 5, wherein;

said other on-off valve is a check valve which allows a flow of refrigerant from said outlet of said compressor to said outlet of said compressor bypass pipe and prohibits a back flow flowing.

7. An air conditioner according to claim 3, further comprising:

another bypass pipe for connecting an outlet of said compressor and said inlet of said accumulator; and another on-off valve interposed into said other bypass pipe.

8. An air conditioner according to claim 1, further comprising:

a liquid receiver for storing a refrigerant liquid provided in a pipe between an outlet of said condenser and an inlet of said electronic expansion valve.

9. An air conditioner according to claim 1, further comprising:

an oil separator for separating a refrigerating machine oil provided in a pipe between an outlet of said compressor and said inlet of said condenser.

10. An air conditioner according to claim 1, further comprising:

an expansion valve bypass pipe for connecting an outlet of said condenser and an inlet of said evaporator; and another valve interposed in said expansion valve bypass pipe.

11. An air conditioner comprising:

a refrigeration circuit formed by sequentially connecting a compressor, a condenser, an expansion valve, and an evaporator by pipes;

a compressor bypass pipe for connecting an outlet of said evaporator and an inlet of said condenser interposing a first on-off valve;

an other on-off valve provided in a pipe between an outlet of said compressor and an outlet of said compressor bypass pipe; and a controller for switching to one of:

a forced circulation operation in which said first on-off valve is closed and said other on-off valve is opened to render said compressor in a running state, and a natural circulation operation in which said first on-off valve is opened and said other on-off valve is closed to render said compressor in a stopping state, wherein the on-off valves are automatically closed in response to pressure differences within the air conditioner, and wherein the controller controls an opening degree of the expansion valve.

12. An air conditioner according to claim 11, wherein:

said other on-off valve is a check valve which allows a flow of refrigerant from said outlet of the said compressor to said outlet of said compressor bypass pipe and prohibits a back flow flowing.

13. An air conditioner according to claim 11, wherein:

a refrigerant which flows into said condenser flows downward in said condenser.

14. An air conditioner comprising:

a refrigeration circuit formed by sequentially connecting a compressor, a condenser, an expansion valve, and an evaporator by pipe;

a compressor bypass pipe for connecting an outlet of said evaporator and an inlet of said condenser interposing a first on-off valve;

another on-off valve provided in a pipe between an outlet of said compressor and an outlet of said compressor bypass pipe; and wherein said air conditioner is selectively switchable to one of:

a forced circulation operation in which said first on-off valve is closed and said other valve is opened to render said compressor in a running state, and a natural circulation operation in which said first on-off valve is opened and said other on-off valve is closed to render said compressor in a stopping state, wherein a refrigerant which flows into said condenser flows downward in said condenser, further including:

a plurality of refrigerant paths in said condenser formed by dividing refrigerant pipes in a vertical direction of said condenser; and a subcooling portion formed in a lower portion of said condenser, wherein branched flows of said refrigerant respectively pass through said refrigerant paths downward and join at an outlet of said condenser.

15. An air conditioner comprising:

a refrigeration circuit formed by sequentially connecting a compressor, a condenser, an expansion valve, and an evaporator by pipe;

a compressor bypass pipe for connecting an outlet of said evaporator and an inlet of said condenser interposing a first on-off valve;

another on-off valve provided in a pipe between an outlet of said compressor and an outlet of said compressor bypass pipe; and wherein said air conditioner is selectively switchable to one of:

a forced circulation operation in which said first on-off valve is closed and said other valve is opened to render said compressor in a running state, and a natural circulation operation in which said first on-off valve is opened and said other on-off valve is closed to render said compressor in a stopping state, wherein:

a plurality of refrigerant paths are provided in said condenser by dividing refrigerant pipes in a vertical direction of said condenser to form an upper refrigerant path and a lower refrigerant path, wherein branches of said refrigerant respectively flow through said refrigerant paths in a downward direction and join at the outlet of said condenser, and wherein the length of said upper refrigerant path is longer than the length of said lower refrigerant path.

16. An air conditioner according to claim 11, wherein:

the refrigerant which flows into said evaporator flows upward in said evaporator.

17. An air conditioner comprising:

a refrigeration circuit formed by sequentially connecting a compressor, a condenser, an expansion valve, and an evaporator by pipes;

a compressor bypass pipe for connecting an outlet of said evaporator and an inlet of said condenser interposing a first on-off valve;

an other on-off valve provided in a pipe between an outlet of said compressor and an outlet of said compressor bypass pipe; and a controller for switching to one of:

a forced circulation operation in which said first on-off valve is closed and said other on-off valve is opened to render said compressor in a running state and;

a natural circulation operation in which said first on-off valve is opened and said other on-off valve is closed to render said compressor in a stopping state, wherein the on-off valves are automatically closed in response to pressure differences within the air conditioner; and wherein a tube diameter of a pipe between said outlet of said evaporator and said inlet of said condenser is larger than the tube diameter of a pipe between an outlet of said condenser and an inlet of said evaporator.

18. An air conditioner according to claim 1, wherein:

an area of heat transfer surface of said evaporator is larger than that of said condenser.

19. An air conditioner, comprising:

a refrigeration circuit formed by sequentially connecting a compressor, a condenser, an electronic expansion valve capable of controlling an opening degree thereof, and an evaporator by pipes;

a compressor bypass pipe connecting an outlet of said evaporator and an inlet of said condenser interposing a first on-off valve;

the air conditioner is switched to a forced circulation operation in which said first on-off valve is closed and said compressor is in a running state or to a natural circulation operation in which said first on-off valve is opened and said compressor is in a stopping state, and the opening degree of said electronic expansion valve is controlled respectively in accordance with said forced circulation operation and said natural circulation operation;

wherein the height of an outlet of refrigerant pipe of said condenser is higher than the height of an outlet of refrigerant pipe of said evaporator by a distance of between 0.5 m and 2 m.

20. An air conditioner according to claim 1, wherein:

an outlet of said condenser is disposed at a lower portion than a bottom portion of a receiver of said condenser.

21. A process using an air conditioner, the air conditioner comprising a refrigeration circuit formed by sequentially connecting a compressor, a condenser, an electronic expansion valve capable of controlling an opening degree thereof, and an evaporator by pipes, the air conditioner further including a compressor bypass pipe connecting an outlet of the evaporator and an inlet of the condenser and interposing a first on-off valve, the process comprising the steps of:

instructing said air conditioner to switch to a forced circulation operation or a natural circulation operation;

in response to an instruction to switch to the forced circulation operation, closing the first on-off valve, opening the expansion valve to a first degree of opening to allow refrigerant to pass therethrough, and operating the compressor in a running state; and in response to an instruction to switch to the natural circulation operation, opening the first on-off valve, opening the expansion valve to a second degree, different from the first degree, to allow refrigerant to pass therethrough, and stopping the compressor.

22. An air conditioner according to claim 11, further comprising an accumulator disposed between the outlet of said evaporator and the inlet of said compressor.

* * * * *